US012662285B2

(12) United States Patent
Bressan et al.

(10) Patent No.: US 12,662,285 B2
(45) Date of Patent: Jun. 23, 2026

(54) CHILD-PROOF CONTAINER AND PROCESS OF MAKING THE SAME

(71) Applicant: I.G.B. S.r.l., Milan (IT)

(72) Inventors: Alessio Bressan, Varese (IT); Michel Bressan, Induno Olona (IT); Alberto Gandolla, Induno Olona (IT)

(73) Assignee: I.G.B. S.r.l., Milan (IT)

( * ) Notice: Subject to any disclaimer, the term of this patent is extended or adjusted under 35 U.S.C. 154(b) by 15 days.

(21) Appl. No.: 18/637,122

(22) Filed: Apr. 16, 2024

(65) Prior Publication Data

US 2024/0351738 A1 Oct. 24, 2024

(30) Foreign Application Priority Data

Apr. 20, 2023 (IT) ..... 102023000007758

(51) Int. Cl.
*B65D 5/66* (2006.01)

(52) U.S. Cl.
CPC ..... *B65D 5/6652* (2013.01); *B65D 2215/00* (2013.01)

(58) Field of Classification Search
CPC .. B65D 5/6652; B65D 2215/00; B65D 5/685; B65D 2215/02; B65D 5/6608; B65D 5/0254; B65D 2215/04; B65D 5/103; B65D 5/106; B65D 55/026; B65D 2215/08; B65D 2211/00; B65D 2401/00; B65D 5/2057
USPC ..... 229/124, 148, 102, 122, 125.26, 154, 229/155, 160.2; 206/807, 815, 532, 1.5
See application file for complete search history.

(56) References Cited

U.S. PATENT DOCUMENTS

| | | | | |
|---|---|---|---|---|
| 1,130,271 | A | 3/1915 | Hammond | |
| 3,116,007 | A | 12/1963 | D'Esposito et al. | |
| 10,189,625 | B2 * | 1/2019 | Bressan | B65D 5/0254 |
| 11,365,034 | B2 | 6/2022 | Bressan et al. | |
| 2018/0162587 | A1 * | 6/2018 | Bressan | B65D 5/0254 |
| 2018/0170635 | A1 * | 6/2018 | Bressan | B65D 55/028 |
| 2019/0009944 | A1 * | 1/2019 | Bressan | B65D 5/2057 |
| 2019/0100346 | A1 * | 4/2019 | Bressan | B65D 5/6608 |
| 2020/0031514 | A1 * | 1/2020 | Bressan | B65D 55/024 |
| 2020/0331667 | A1 * | 10/2020 | Bressan | B65D 50/045 |
| 2023/0032257 | A1 * | 2/2023 | Bressan | B65D 5/103 |
| 2023/0303289 | A1 * | 9/2023 | Bressan | B65D 5/0254 |

FOREIGN PATENT DOCUMENTS

| | | | |
|---|---|---|---|
| EP | 3981700 | A1 | 4/2022 |
| JP | 2014141276 | A | 8/2014 |
| WO | 2016198978 | A1 | 12/2016 |

OTHER PUBLICATIONS

Search Report and Written Opinion for IT Application No. 202300007758 dated Nov. 3, 2023, 6 pages.
EP 24167919.0, European Search Report (Sep. 9, 2024).

* cited by examiner

*Primary Examiner* — Christopher R Demeree
(74) *Attorney, Agent, or Firm* — Nixon & Vanderhye P.C.

(57) ABSTRACT

A child-proof container including a storage for housing a product and a closure system that defines a closure condition and an open condition of the container. The container has a first coupling portion carried by the closure system and a second coupling portion carried by the storage which cooperates with the first coupling portion to define a locking condition where the first and second coupling portions prevent the closure system from switching from the closure condition to the open condition.

18 Claims, 6 Drawing Sheets

CHILD-PROOF CONTAINER AND PROCESS OF MAKING THE SAME

RELATED APPLICATION

This application incorporates by reference and claims priority to Italian patent application 102023000007758, filed Apr. 20, 2023.

FIELD OF INVENTION

The present invention refers to a child-proof container and a process of making said container, as well as a method of closing and opening said container. The container may find application in fields involving product packaging and where inhibition of container opening by children is required for safety reasons, such as, for example, the pharmaceutical, cosmetic and food fields.

BACKGROUND

Child-proof containers designed to prevent children from coming into contact with products that may damage them are known. In a first example, described in PCT Patent Application No. WO 2016/198978 A1, a child-proof container comprises a container that can be closed by means of a closure system linked to the storage. The closure system carries a coupling portion suitable for coopering, in the closure condition of the container, with a respective coupling portion placed in the storage. The closure system has a slot suitable for allowing the insertion of an opening device configured to disengage the coupling portions and thereby allowing the container to be opened.

In a second example, described in U.S. Pat. No. 11,365,034B2, a child-proof container also having a storage that can be closed by means of a closure system is described. The storage carries a coupling portion which comprises a first and a second tabs folded in a "V" shape; an elongated cut is defined on the first tab that defines a slot configured to receive in insertion a respective tab carried by the closure system. During an attempt to open the container, and then only when the closure system is moved upward relative to the storage, the tab carried by the closure system is configured to insert into the slot of the coupling portion carried by the storage to allow locking the closure system and thus preventing the container from being fully opened.

The containers described in the examples above are of the child-proof type, that is, they have a particularly effective container locking system capable of preventing forced opening attempts by children. The U.S. Pat. Nos. 1,130,271A and 3,116,007A are directed to containers in paper material that allow automatic locking of the closure system; however, these containers are not child-proof. These containers comprise a storage lockable by un outer case configured to wrap at least partially around the lateral walls of the storage. The storage has a pair of tabs whose head edge is configured to contact a respective inner tab carried by the case.

Although the known containers described above allow the closure system to be engaged to the storage, the Applicant noted that these containers are improvable in several respects.

SUMMARY

Scope of the present invention is therefore to substantially solve at least one of the drawbacks and/or limitations of the previous solutions.

The present invention may be embodied to provide a container that may effectively inhibit the opening of the same by a child while at the same time having a solid structure capable of ensuring its integrity following multiple openings and closings of the same. It is then scope of the present invention to provide a container that is effective in closure but at the same time may be flexible in its use, that is, one that can be easily opened by an adult manually and/or by means of different opening devices.

In an aspect, a child-proof container (1) is provided, said container comprises:

- a storage (2) defining a compartment (3) for housing at least one product, the storage (2) having a predetermined number of lateral walls defining at least one passage opening (5) delimited by an edge (6), said passage opening (5) being configured to put the compartment (3) in communication with the external environment,
- at least one closure system (7) relative movable with respect to the storage (2) at least between:
- a closure condition where the closure system (7) interdicts communication between the compartment (3) and the external environment, and
- an open condition where the closure system (7) allows communication between the compartment (3) and the external environment,
- at least one first coupling portion (12) carried by the closure system (7),
- at least one second coupling portion (13) carried by storage (2),
- wherein the first and second coupling portions (12, 13), in the closure condition, are configured to engage each other to define a locking condition of the container wherein said first and second coupling portions (12, 13) prevent the closure system (7) to switch from the closed condition to the open one.

In an aspect according to the preceding aspect the storage (2) is in sheet material, optionally paper material. In an aspect according to any one of the preceding aspects the predetermined number of lateral walls defines a first and a second passage opening (5) opposed to each other and configured to place the compartment (3) in communication with the external environment, each of said first and second passage openings being delimited by a respective edge (6). In an aspect according to any one of the preceding aspects, the predetermined number of lateral walls of the storage (2) comprises at least one front wall (4*a*) and one opposed rear wall (4*b*) spaced apart and connected to each other by a first and a second lateral wall (4*c*, 4*d*) also opposed to each other. In an aspect according to any one of the preceding aspects, the storage (2) has a substantially rectangular parallelepiped shape. In an aspect according to any one of the preceding aspects each of said lateral walls (optionally the front wall 4*a*, the rear wall 4*b*, the first lateral wall 4*c* and the second lateral wall 4*d*) is delimited by a perimeter edge having a polygonal outline, optionally rectangular.

In an aspect according to any one of the preceding aspects each of said lateral walls (optionally front wall 4*a*, rear wall 4*b*, first lateral wall 4*c* and second lateral wall 4*d*) is defined (optionally formed) by a single sheet, optionally of paper material. In an aspect according to the preceding aspect the single sheet of each lateral wall extends in thickness between a first and a second surface, wherein the first surface defines at least one inner surface of the storage directly defining at least part of the compartment (3), wherein the second surface defines at least one outer surface of the storage (2).

In an aspect according to any one of the preceding aspects the front wall (4*a*), rear wall (4*b*), first lateral wall (4*c*) and second lateral wall (4*d*) are joined in one piece, optionally to define a single sheet of paper material.

In an aspect according to any one of the preceding aspects, the front wall (4*a*) comprises, at and in continuity with the edge (6), a lowering (23). In an aspect according to any one of the preceding aspects, the lowering (23) is configured to allow a user, in the locking condition, to grip the closure system (7) to allow, following disengagement of the first and second coupling portions (12, 13) to move the closure system from the closure condition to the open condition, optionally extracting the first coupling portion (12) from the compartment (3). In an aspect according to any one of the preceding two aspects, the lowering (23), in the closure condition, is configured to allow at least partial exposure of the closure system (7) which is visible and reachable by the user from outside the container (1).

In an aspect according to any one of the preceding aspects the closure system (7) is in sheet material, optionally paper material. In an aspect according to any one of the preceding aspects the closure system (7) is joined in a single piece to the storage (2). In an aspect according to any one of the preceding aspects the container comprises a closure system (7) for each passage opening (5) of the storage.

In an aspect according to any one of the preceding aspects, the closure system (7) comprises a closure portion (9) configured to at least partially occlude, in the closure condition, the at least one passage opening (5) of the storage (2). In an aspect according to any one of the preceding aspects, the closure portion (9) is at least partially counter-shaped to the edge (6) delimiting said at least one passage opening (5). In an aspect according to any one of the preceding aspects, the closure system (7) is substantially hinged to the edge (6) of the storage (2).

In an aspect according to any one of the preceding aspects the closure portion (9) is directly hinged to the edge (6) of the storage (2), optionally to the edge defined by the rear wall (4*b*). In an aspect according to any one of the preceding aspects, the closure portion (9) is delimited by a perimeter edge having a substantially rectangular outline.

In an aspect according to any one of the preceding aspects, the closure system (7) further comprises at least one inserting portion (10) engaged to the closure portion (9) at a fold edge (9*a*), optionally opposite the edge (6) of the storage (2) to which the closure portion (9) is directly engaged. In an aspect according to the preceding aspect, the inserting portion (10), in the closure system condition, is configured to insert at least partially (optionally entirely) into the compartment (3) of the storage system (2). In an aspect according to any one of the preceding aspects, the closure portion (9) is interposed between the inserting portion (10) and the rear wall (4*b*) of the storage (2). In an aspect according to any one of the preceding aspects the inserting portion (10) is joined in a single piece with the closure portion (9). In an aspect according to any one of the preceding aspects the inserting portion (10) extends seamlessly from the closure portion (9). In an aspect according to any one of the preceding aspects the inserting portion (10), in the closure condition, faces the front wall (4*a*) of the storage (2). In an aspect according to any one of the preceding aspects, the inserting portion (10), in the closure condition, is at least partially in contact with the front wall (4*a*) of the storage (2).

In an aspect according to any one of the preceding aspects, the inserting portion (10) has at least one gripping portion configured to allow a user, at least in the closure condition of the container, to grip the closure system (7) to allow the first coupling portion (12) to be extracted from the second coupling portion (13). In an aspect according to the preceding aspect, the gripping portion is joined in a single piece with the inserting portion (10). In an aspect according to any one of the preceding two aspects the gripping portion at least partially faces the lowering (23).

In an aspect according to any one of the three preceding aspects the inserting portion (10) and the gripping portion lie on a single development plane. In an aspect according to any one of the four preceding aspects, the gripping portion has no weakening portions, optionally configured to allow the inserting portion (10) to be easily broken.

In an aspect according to any one of the preceding aspects, the second coupling portion (13) comprises at least one panel. In an aspect according to the preceding aspect the at least one panel comprises at least one opening delimited at least in part by a gripping edge (13*d*) configured to engage, in the closure condition, the first coupling portion to define said locking condition. In an aspect according to the preceding aspect the at least one panel is directly carried by the storage (2). In an aspect according to any one of the preceding two aspects the at least one panel of the second coupling portion faces a lateral wall of the storage (2). In an aspect according to any one of the three preceding aspects the at least one panel of the second coupling portion (13) faces and at least partially directly contact a lateral wall of the storage (2). In an aspect according to any one of the four preceding aspects the at least one panel of the second coupling portion (13) is directly facing, optionally at least partially contacting, a front wall (4*a*) of the storage (2). In an aspect according to any one of the preceding five aspects the at least one panel of the second coupling portion (13) is engaged to the front wall (4*a*) of the storage (2).

In an aspect according to any one of the preceding aspects the opening defined on the panel of the second coupling portion (13) pass-through said at least one panel. In an aspect according to any one of the preceding aspects the opening, optionally the through opening, defined on the panel of the second coupling portion (13) is delimited by a perimeter edge having a substantially rectangular outline. In an aspect according to any one of the preceding aspects, the gripping edge (13*d*) of the panel delimiting at least part of said opening is spaced from the edge (6) of the storage (2). In an aspect according to any one of the preceding aspects the gripping edge (13*d*) is optionally placed in the compartment (3) in both the closure condition and the open condition of the closure system (7). In an aspect according to any one of the preceding aspects, the gripping edge (13*d*) of the second coupling portion (13) has a straight or "C" or "V" shape.

In an aspect according to any one of the preceding aspects, the edge (6) of the storage (2) lies on a plane, wherein at least one section of the gripping edge (13*d*) is parallel to the lying plane of the edge (6) of the storage (2).

In an aspect according to any one of the preceding aspects the second coupling portion (13) is arranged at least partially in the compartment (3). In an aspect according to any one of the preceding aspects, the second coupling portion (13) is directly engaged to a lateral wall of the storage (2). In an aspect according to any one of the preceding aspects, the second coupling portion (13) is directly carried by the front wall (4*a*) of the storage (2).

In an aspect according to any one of the preceding aspects the second coupling portion (13) is movable at least partially relative to the storage (2) at least between:

a blocking position where the second coupling portion (13) is configured to engage the first coupling portion (12), optionally preventing its disengagement, and a release position where the second coupling portion (13) is configured to disengage the first coupling portion (12) to allow the closure system (7) to switch from the closure condition to the open condition.

In an aspect according to the preceding aspect, the gripping edge (13*d*), in the blocking position, presents a distance from the lateral wall of the storage directly carrying the second coupling portion, optionally from the front (4*a*), less than a distance present between said gripping edge (13*d*) and said lateral wall when the second coupling portion is in the release position.

In an aspect according to any one of the preceding aspects the at least one panel of the second coupling portion (13) lies on a plane. In an aspect according to the preceding aspect the plane of lying of the at least one panel of the second coupling portion (13), in the blocking position, is substantially parallel to a plane of lying of the lateral wall of the storage directly carrying said second coupling portion (13), optionally it is substantially parallel to a lying plane of the front wall (4*a*) of the storage (2) directly carrying said second coupling portion (13). In an aspect according to any one of the preceding two aspects, the lying plane of the at least one panel of the second coupling portion (13), in the release position, is tilted with respect to a lying plane of the lateral wall of the storage directly carrying said second coupling portion (13), optionally is tilted with respect to a lying plane of the front wall (4*a*) of the storage (2) directly carrying said second coupling portion (13). In an aspect according to the preceding aspect, the tilting angle between the laying plane of the at least one panel and the laying plane of the lateral wall of the storage directly carrying the second coupling portion (13), in the release position, is greater than 1°, optionally is between 2° and 20°, even more optionally is between 2° and 15°.

In an aspect according to any one of the preceding aspects the at least one panel of the second coupling portion (13) comprises: at least one first panel (13*a*) comprises said at least one opening delimited at least in part by said gripping edge (13*d*), and at least one second panel (13*b*) facing the first panel (13*a*).

In an aspect according to the preceding aspect said at least one opening passes through the first panel (13*a*). In an aspect according to any one of the preceding two aspects the first panel (13*a*) is interposed between said second panel (13*b*) and the lateral wall of said storage (2) directly carrying the second coupling portion (13), optionally between said second panel (13*b*) and the front wall (4*a*) of said storage (2). In an aspect according to any one of the three preceding aspects, the first panel (13*a*) is at least partially in direct contact with the front wall (4*a*) of the storage (2). In an aspect according to any one of the four preceding aspects at least one of the first and second panels (13*a*, 13*b*) is directly constrained to the front wall (4*a*) of the storage (2), optionally by gluing. In an aspect according to any one of the preceding five aspects the gripping edge (13*d*) is exclusively defined on the first panel (13*a*).

In an aspect according to any one of the preceding aspects, the second panel (13*b*) is arranged at the through opening of the first panel (13*a*) to define, in cooperation with said through opening of the first panel (13*a*), a seat (40) configured to house, during the closure condition of the closure system (7), at least part of the first coupling portion (12), optionally to allow the engagement of said first coupling portion (12) with the second coupling portion (13). In an aspect according to any one of the preceding aspects, the second panel (13*b*) is overlapped to the first panel (13*a*). In an aspect according to any one of the preceding aspects the second panel closes the through opening of the first panel (13*a*) such that the seat (40) of the second coupling portion (13) is blind.

In an aspect according to any one of the preceding aspects the first panel (13*a*) of the second coupling portion (13) is arranged at least partially in the compartment (3) of the storage (2). In an aspect according to any one of the preceding aspects the first panel (13*a*) of the second coupling portion (13) is entirely arranged in the storage (2), optionally it is entirely contained in the compartment (3) of the storage (2). In an aspect according to any one of the preceding aspects the first and second panels (13*a*, 13*b*) are engaged with each other to define a folded portion. In an aspect according to any one of the preceding aspects the folded portion defined by said first and second panels (13*a*, 13*b*) is substantially parallel to a lateral wall (optionally the front side wall 4*a*) of the storage (2) directly carrying said second coupling portion (13). In an aspect according to any one of the preceding aspects, the second panel (13*b*) is directly engaged and overlapped to the first panel (13*a*).

In an aspect according to any one of the preceding aspects at least part of the first panel (13*a*) and at least part of the second panel (13*b*) are movable relative to the storage (2). In an aspect according to any one of the preceding aspects at least part of the first panel (13*a*) and at least part of the second panel (13*b*) are movable relative to the storage (2) to define:

the blocking position of the second coupling portion (13) where said first and second panels (13*a*, 13*b*) are alongside to the lateral wall of the storage directly carrying said second coupling portion (13) (optionally said first and second panels 13*a*, 13*b* are alongside to the front wall 4*a*) and configured to allow, optionally in cooperation with said lateral wall (optionally with front wall 4*a*), the blocking of the first coupling portion (12) in the seat (40), the release position of the second coupling portion (13) where said first and second panels (13*a*, 13*b*) are at least partially spaced from the lateral wall of the storage directly carrying said second coupling portion (13) (optionally said first and second panels 13*a*, 13*b* are alongside to the front wall 4*a*) to allow the disengagement, optionally the extraction, of the first coupling portion (12) from the seat (40).

In an aspect according to any one of the preceding aspects the through opening of the first panel (13*a*) is spaced from the edge (6) of the storage (2). In an aspect according to any one of the preceding aspects the second panel (13*b*) is joined in a single piece to the first panel (13*a*) and folded with respect to the latter at a fold edge (13*c*) spaced from the edge (6) of the storage (2).

In an aspect according to any one of the preceding aspects, the second coupling portion (13) is free of weakenings configured to allow easy breakage of the second coupling portion (13) itself. In an aspect according to any one of the preceding aspects the second coupling portion (13) is in sheet material, optionally paper material. In an aspect according to any one of the preceding aspects the second coupling portion (13) comprises a single folded sheet, optionally paper material. In an aspect according to the preceding aspect the single folded sheet defining said second coupling portion (13) is directly constrained to the edge (6) of the storage (2).

In an aspect according to any one of the preceding aspects the first and second panels (13*a*, 13*b*) of the second coupling portion (13) lie on respective planes. In an aspect according to any one of the preceding aspects, the lying plane of the first panel (13*a*) is substantially parallel to the lying plane of the second panel (13*b*). In an aspect according to any one of the preceding aspects the first and second panels (13*a*, 13*b*) are constrained to each other, optionally by gluing. In an aspect according to any one of the preceding aspects the first and second panels (13*a*, 13*b*) are at least partially movable, optionally tiltable, relative to the lateral wall (2) of the storage (2) directly carrying the second coupling portion (13). In an aspect according to any one of the preceding aspects, the first and second panels (13*a*, 13*b*) are tiltable with respect to the front wall (4*a*) of the storage (2) directly carrying said second coupling portion (13).

In an aspect according to any one of the preceding aspects, the first and second panels (13*a*, 13*b*) of the second coupling portion (13), in the blocking position, are substantially parallel to a plane of lateral wall of the storage directly carrying said second coupling portion (13), optionally they are substantially parallel to a plane of front wall (4*a*) of the storage (2) directly carrying said second coupling portion (13). In an aspect according to any one of the preceding two aspects, the lying plane of the first and second panels (13*a*, 13*b*) of the second coupling portion (13), in the release position, is tilted with respect to a lying plane of the lateral wall of the storage directly carrying said second coupling portion (13), optionally is tilted with respect to a lying plane of the front wall (4*a*) of the storage (2) directly carrying said second coupling portion (13). In an aspect according to the preceding aspect, the tilting angle between the lying plane of the first and second panels and the lying plane of the lateral wall of the storage directly carrying the second coupling portion (13), in the release position, is greater than 1°, optionally it is between 2° and 20°, even more optionally it is between 2° and 15°.

In an aspect according to any one of the preceding aspects at least one of the first panel and the second panel (13*a*, 13*b*), optionally the second panel (13*b*) of the second coupling portion (13), is directly joined in a single piece with the front wall of the storage. In an aspect according to any one of the preceding aspects, the second panel (13*b*) is folded with respect to the lateral wall of the storage (optionally with respect to the front wall 4*a*) to which said second panel (13*b*) is joined in a single piece, in the compartment (3) of the storage. In an aspect according to any one of the preceding aspects, the second panel (13*b*) is directly joined in a single piece with the edge (6) of the storage.

In an aspect according to any one of the preceding aspects, the second coupling portion (13) is exclusively carried by the front wall (4*a*) of the storage (2).

In an aspect according to any one of the preceding aspects the first coupling portion (12) is joined in a single piece with the closure system (7). In an aspect according to any one of the preceding aspects the first coupling portion (12) is directly carried by the inserting portion (10) of the closure system (7). In an aspect according to any one of the preceding aspects the first coupling portion (12) emerges from the inserting portion (10) on the opposite side from the closure portion (9). In an aspect according to any one of the preceding aspects the first coupling portion (12) is in a single piece with the inserting portion (10). In an aspect according to any one of the preceding aspects the first coupling portion (12) extends seamlessly from the inserting portion (10).

In an aspect according to any one of the preceding aspects the first coupling portion (12), in the locking condition, is engaged at the gripping edge (13*b*) of the second coupling portion (13). In an aspect according to any one of the preceding aspects the first coupling portion (12), in the locking condition, is at least partially placed in the compartment (3) of the storage (2), optionally it is entirely placed in the compartment (3) of the storage (2).

In an aspect according to any one of the preceding aspects, the first coupling portion (12) comprises at least one of a first and a second tab (12*a*, 12*b*) made of sheet material, optionally paper material, at least partially facing each other. In an aspect according to the preceding aspect, at least one of the first and second tabs (12*a*, 12*b*) are at least partially facing each other. In an aspect according to any one of the preceding aspects the first and second tabs (12*a*, 12*b*) are constrained to each other, optionally by gluing. In an aspect according to any one of the preceding aspects, the first and second tabs (12*a*, 12*b*) of the first coupling portion (12) are parallel to each other. In an aspect according to any one of the preceding aspects the first tab (12*a*) fully overlaps and in contact with the second tab (12*b*). In an aspect according to any one of the preceding aspects the first tab (12*a*) is glued in overlap with the second tab (12*b*). In an aspect according to any one of the preceding aspects the first and second tabs (12*a*, 12*b*) are joined in a single piece. In an aspect according to any one of the preceding aspects the first and second tabs (12*a*, 12*b*) are engaged with each other to define a folded portion. In an aspect according to any one of the preceding aspects, the first tab (12*a*) is joined in a single piece with the second tab (12*b*) and folded with respect to the latter at a fold edge (12*c*).

In an aspect according to any one of the preceding aspects at least one of the first and second tabs (12*a*, 12*b*), in the locking condition, is engaged to the second coupling portion (13), optionally to the gripping boron (13*d*) of the second coupling portion (13), to define the locking condition. In an aspect according to any one of the preceding aspects, at least one of the first tab and the second tab (12*a*, 12*b*), in the locking condition, is disposed at least partially in the seat (40) of the first panel (13*a*) of the second coupling portion (13) to define the locking condition. In an aspect according to any one of the preceding aspects, the first tab (12*a*), in the locking condition, is disposed at least partially in the seat (40) of the first panel (13*a*) of the second coupling portion (13).

In an aspect according to any one of the preceding aspects, the second tab (12*b*) extends seamlessly from the inserting portion (10) whereas the first tab (12*a*) is folded over the second tab (12*b*). In an aspect according to any one of the preceding aspects at least one of the first and second tabs (12*a*), optionally the first tab, of the first coupling portion (12), in the locking condition, is engaged at the gripping edge (13*d*) of the second coupling portion (13) to define said locking condition.

In an aspect according to any one of the preceding aspects, the first tab (12*a*) defines a support edge (12*d*) which, in the locking condition, is engaged to the gripping edge (13*d*) of the second coupling portion (13), optionally to the gripping edge (13*d*) defined by the first panel (13*a*).

In an aspect according to any one of the preceding aspects, the support edge (12*d*) of the first coupling portion (12), in the locking condition, is spaced from the edge (6) of the storage (2). In an aspect according to any one of the preceding aspects the first tab (12*a*), in the locking condition, directly faces the second panel (13*b*) of the second coupling portion (13). In an aspect according to any one of the preceding aspects, the second tab (12*b*) of the first coupling portion (12), in the locking condition, directly faces the lateral wall of the storage (2) directly carrying the second coupling portion (13). In an aspect according to any one of the preceding aspects, the second tab (12*b*) of the first coupling portion (12), in the locking condition, directly faces the front wall (4*a*) of the storage (2), optionally directly carrying the second coupling portion (13). In an aspect according to any one of the preceding aspects, the first tab (12*a*) is at least partially countershaped to the seat (40) of the second coupling portion (13). In an aspect according to any one of the preceding aspects at least the first tab is delimited by a perimeter edge having a substantially polygonal, optionally rectangular outline.

In an aspect according to any one of the preceding aspects, the first and second tabs (12*a*, 12*b*) of the first coupling portion (12), in the locking condition, are arranged completely in the compartment (3) of the storage (2). In an aspect according to any one of the preceding aspects, the first and second tabs (12*a*, 12*b*) of the first coupling portion (12), in the locking condition, are spaced apart from the edge (6) of the storage. In an aspect according to any one of the preceding aspects, the support edge (12*d*) defined by the first tab (12*a*) is opposed to the fold edge (12*c*) of the first and second tabs (12*a*, 12*b*).

In an aspect according to any one of the preceding aspects, the first tab (12*a*) of the first coupling portion, in the locking condition, is disposed in the seat (40) of the first panel (13*a*) of the second coupling portion (13), in interposition between the second tab (12*b*) of the first coupling portion and the second panel (13*b*) of the second coupling portion (13). In an aspect according to any one of the preceding aspects, the first tab (12*a*) of the first coupling portion, in the locking condition, is at least partially in direct contact, on one side, with the second tab (12*b*) of the first coupling portion and, on the opposite side, with the second panel (13*b*) of the second coupling portion (13).

In an aspect according to any one of the preceding aspects the second tab (12*b*) of the first coupling portion (12), in the locking condition, is interposed between the lateral wall of the storage directly carrying the second coupling portion (optionally the front wall 4*a*) and the first tab (12*a*) of the first coupling portion (12) which is engaged in the seat (40) of the first panel (13*a*). In an aspect according to any one of the preceding aspects, the second tab (12*b*) of the first coupling portion (12), in the locking condition, is at least partially in direct contact, from one side, with the lateral wall of the storage directly carrying the second coupling portion (13) and, on the opposite side, with the first tab (12*a*) of the first coupling portion itself.

In an aspect according to any one of the preceding aspects at least part of the first and second panels (13*a*, 13*b*) of the second coupling portion, in the locking condition, is movable from the blocking position to the release position away from the lateral wall of the storage directly carrying the second coupling portion.

In an aspect according to any one of the preceding aspects the closure system (7) comprises at least one through access (26). In an aspect according to any one of the preceding aspects the through access (26), in the closure condition of the closure system (7), is configured to place the compartment (3) of the storage (2) in communication with the external environment. In an aspect according to any one of the preceding aspects the through access (26) is configured to allow (optionally from the outside of the container) to act on at least a portion of the second coupling portion (13) to allow disengagement with the first coupling portion (12).

In an aspect according to any one of the preceding aspects the through access (26) is configured to allow, in the locking condition, at least the insertion of an opening device (19) in interposition between the first panel (13*a*) of the second coupling portion and the first coupling portion (optionally the first tab 12*a*) to allow disengagement between said first coupling portion (12) and said second coupling portion (13). In an aspect according to any one of the preceding aspects, the through access (26) is configured to allow, in the locking condition, at least the insertion of an opening device (19) at least partially within the seat (40) to allow the first coupling portion (12) to be extracted from the seat (40) in such a manner as to allow subsequent disengagement between said first coupling portion (12) and said second coupling portion (13).

In an aspect according to any one of the preceding aspects, the through access (26) is configured to allow a user, from outside the container, to engage the closure system (7) and thereby allow, following disengagement between the first and second coupling portions (12, 13), the first coupling portion (12) to be extracted from the seat (40). In an aspect according to any one of the preceding aspects, the first and second coupling portions (12, 13) are disengageable following the extraction of the first coupling portion (optionally the first tab 12*a*) from the seat (40).

In an aspect in accordance with any one of the preceding claims the through access (26) is at least partially delimited by a perimeter edge defined on the closure portion (9) and/or the inserting portion (10) of the closure system (7). In an aspect according to the preceding claim the through access (26) is defined entirely on the closure portion (9), optionally exclusively on the closure portion (9). In an aspect according to the preceding claim the through access (26) is defined entirely on the inserting portion (10), optionally exclusively on the inserting portion (10). In an aspect according to the preceding claim the through access (26) is defined on the closure portion (9) and the inserting portion (10).

In an aspect according to any one of the preceding aspects, the through access (26) is configured to allow a user, from outside the container, to grasp the inserting portion (optionally the gripping portion of the inserting portion 10) and pull the first coupling portion (12) out of the storage (2). In an aspect according to any one of the preceding aspects, the gripping portion of the inserting portion (10) at least partially delimits the through access (26).

In an aspect according to any one of the preceding aspects, the closure portion (9) of the closure system (7) defines a gripping portion disposed at the through access (26) and configured to allow a user, following disengagement of the first and second coupling portions (12, 13), to move said closure system (7) from the closure condition to the open condition. In an aspect according to the preceding aspect the gripping portion of the closure portion (9) delimits at least part of said through access (26).

In an aspect according to any one of the preceding aspects, the through access (26) is delimited by a closed perimeter edge. In an aspect according to the preceding aspect the perimeter edge delimiting the through access (26) has a polygonal outline, optionally rectangular.

In an aspect according to any one of the preceding aspects, the through access (26) is configured to allow a user to intervene (optionally manually and/or by means of an opening device) on the second coupling portion (13) to move the latter from the blocking position to the release position. In an aspect according to any one of the preceding aspects, the through access (26) is configured to allow a user to intervene (optionally manually and/or by means of an opening device) directly on at least the first panel (13*a*) of the second coupling portion (13) to move the latter (optionally both the first panel 13*a* and the second panel 13*b*) from the blocking position to the release position.

In an aspect according to any one of the preceding aspects the container (1) comprises a thrust portion (21) carried by the second coupling portion (13) and positioned at the through access (26), said thrust portion (21) being configured to allow displacement of at least part of said second coupling portion (13) to allow disengagement with the first coupling portion (12). In an aspect according to the preceding aspect, said thrust portion (21) being configured to allow displacement of at least part of said second coupling portion (optionally displacing the first and second panels) from the blocking position to the release position.

In an aspect according to any one of the preceding aspects the through access (26) is configured to allow a user, in the locking condition and from outside the container, to intervene (optionally manually and/or by means of an opening device 19) on the thrust portion (21). In an aspect according to any one of the preceding aspects, the through access (26) is configured to allow a user, in the locking condition and from outside the container, to intervene (optionally manually and/or by means of an opening device 19) on the thrust portion (21) to allow at least part of the second coupling portion (13) to be moved from the blocking position to the release position. In an aspect according to any one of the preceding aspects, the thrust portion (21), at least in the locking condition, passes through at least part of said through access (26), optionally exiting at least part of the container. In an aspect according to any one of the preceding aspects, the through access (26) has a passage section greater than a size of the thrust portion (21).

In an aspect according to any one of the preceding aspects, the thrust portion (21), in the release position of the second coupling portion (13), has a minimum distance from the edge (6) of the storage (2) greater than a minimum distance present between said thrust portion (21) and said edge (6) when said second coupling portion (13) is in the blocking position. In an aspect according to any one of the preceding aspects, at least part of the thrust portion (21), in the locking condition, is directly facing and placed near the through access (26). In an aspect according to any one of the preceding aspects at least part of the thrust portion (21), in the locking condition, passes through the through access (26) and protrudes from the closure system (7) by a predetermined height. In an aspect according to any one of the preceding aspects, at least part of the thrust portion (21), in the locking condition, passes through the through access (26) and protrudes from the edge (6) of the storage (2) for a predetermined height. In an aspect according to any one of the preceding aspects, the ratio between the height of the thrust portion (21) emerging from the edge (6) of the storage (2) and the extension of the thrust portion (21) itself is greater than 0.1, optionally between 0.2 and 0.9, even more optionally between 0.3 and 0.8. In an aspect according to any one of the preceding aspects, the height of the thrust portion (21) emerging from the edge (6) is greater than 2 mm, optionally between 3 mm and 10 mm. In an aspect according to any one of the preceding aspects the through access (26), in the closure condition, is placed at the edge (6) of the storage (2).

In an aspect according to any one of the preceding aspects excluding the nine preceding aspects the thrust portion (21), in the locking condition, is entirely housed in the compartment (3) of the storage (2). In an aspect according to any one of the preceding aspects the thrust portion (21), in the locking condition, is facing the through access (26).

In an aspect according to any one of the preceding aspects, the through access (26) is configured to allow a user, from outside the container, to contact (optionally manually) said thrust portion (21) to move said first and second panels (13*a*, 13*b*) from the blocking position to the release position.

In an aspect according to any one of the preceding aspects the thrust portion (21) is defined on at least one of the first and second panels (13*a*, 13*b*). In an aspect according to any one of the preceding aspects the thrust portion (21) is joined in a single piece with the first and/or second panel of the second coupling portion (13). In an aspect according to any one of the preceding aspects the thrust portion (21) emerges from at least one of the first and second panels (13*a*, 13*b*). In an aspect according to any one of the aspects the thrust portion (21) lies in a plane parallel to, optionally coincident with, the lying plane of the first and second panels (13*a*, 13*b*). In an aspect according to any one of the preceding aspects the thrust portion (21) defines with the first and/or second panel (13*a*, 13*b*) a single sheet of paper material. In an aspect according to any one of the preceding aspects, the thrust portion (21) is jointly movable at least with the first panel (13*a*), optionally between the blocking position and the release position, and vice versa.

In an aspect according to any one of the preceding aspects, the thrust portion (21), in the locking condition, emerges from the first panel (13*a*), optionally away from gripping edge (13*d*). In an aspect according to any one of the preceding aspects, the thrust portion (21) is at least partially facing the through access (26).

In an aspect according to any one of the preceding aspects, the through access (26) is configured to allow a user, from outside the container, to manually contact said thrust portion (21) to move said first and second panels (13*a*, 13*b*) from the blocking position to the release position.

In an aspect according to any one of the preceding aspects the thrust portion (21), at least in the locking condition, is configured to guide the insertion of the opening device (19) in interposition between the first panel (13*a*) and the lateral wall of the storage (2) directly carrying the second coupling portion (13). In an aspect according to any one of the preceding aspects, the thrust portion (21), at least in the locking condition, is configured to guide the insertion of at least part of the opening device (19) into the seat (40) to allow disengagement between the first and second coupling portions (12, 13).

In an aspect according to any one of the preceding aspects the through access (26) is configured to allow the thrust portion (21), in the locking condition, to protrude outside of the container (1) to allow a user to manually and/or by means of an opening device (19) intervene on said thrust portion (21) and thereby move at least part of the second coupling portion (13), from the blocking position to the release position. In an aspect according to any one of the preceding aspects, the through access (26) extends from the fold edge (9*a*) toward a central area of said closure portion (9) to define a depth of said through access (26). In an aspect according to any one of the preceding aspects, the through access (26) has a predetermined width measured along a direction parallel to the fold edge (9*a*) of the closure system (7). In an aspect according to any one of the preceding aspects, the ratio of the width of the through access (26) to a width of the closure portion (9) measured along the width of the through access is between 0.15 and 0.5, optionally between 0.2 and 0.45. In an aspect according to any one of the preceding aspects, the ratio of the depth of the through access (26) to a depth of the closure portion (9), measured along the depth of the through access (26), is between 0.15 and 0.4. In an aspect according to any one of the preceding aspects, the through access (26) has a substantially square or rectangular or substantially "T-shaped" outline. In an aspect according to any one of the preceding aspects the ratio between a width of the thrust portion (21) and the width of the through access (26) is between 0.7 and 1, optionally between 0.8 and 0.98; said widths being measured along a direction parallel to the fold edge (9*a*) of the closure system (7). In an aspect according to any one of the preceding aspects the thrust portion (21) extends in thickness between a first and a second surface opposed to each other, the ratio of the thickness of the thrust portion (21) to the depth of the through access (26), is between 0.02 and 0.15, optionally between 0.03 and 0.1 (optionally said thickness of the thrust portion is measured along the depth of the through access).

In an aspect according to any one of the preceding aspects the container comprises at least one opening device (19) insertable, at least in the locking condition, through the through access (26) in interposition between the first and second coupling portions (12, 13), optionally between the first panel (13*a*) of the second coupling portion (13) and the first tab (12*a*) of the first coupling portion (12). In an aspect according to any one of the preceding aspects the thrust portion (21) and/or the gripping portion of the coupling portion (10), at least in the locking condition, are configured to guide the insertion of the opening device (19) in interposition between the first and second coupling portions (12, 13), optionally between the first panel (13*a*) of the second coupling portion (13) and the first tab (12*a*) of the first coupling portion (12). In an aspect according to any one of the preceding aspects, the opening device (19) is insertable, at least in the locking condition, directly into the seat (40) of the second coupling portion (13) to allow the first coupling portion (12) to be pulled out. In an aspect according to any one of the preceding aspects, the opening device (19) comprises: at least one gripping portion configured to allow the user to manually grasp the opening device (19), and at least one release portion, emerging from the gripping portion (19*a*), configured to be inserted, in the locking condition, through the through access (26) in interposition between the first and second coupling portions (12, 13).

In an aspect according to any one of the preceding aspects the first and second coupling portions (12, 13) are configured to re-engage following an open condition of the container subsequent to a locking condition. In an aspect according to any one of the preceding aspects, the first and second coupling portions (12, 13) are free of weakenings and/or removable portions.

In an aspect there is a process of making a container (1) according to any one of the preceding aspects. In an aspect according to the preceding aspect the process of making a container comprises the steps of:

preparing a flat (50) blanks in sheet material, bending said blank (50) for making said storage and closure system respectively carrying the second coupling portion and the first coupling portion.

In an aspect according to the preceding aspect the blank (50) is in single sheet, optionally of paper material. In an aspect according to any one of the preceding two aspects, the step of preparing the blank (50) comprises the sub-steps of:

preparing a single flat sheet, optionally in paper material, cutting said single sheet, optionally by a die-cutting step.

In an aspect according to any one of the three preceding aspects the blank (50) comprises:

a first sheet (51) comprising at least one first and a second portion (52, 54) interconnected by a central connecting portion (53), the first sheet (51) further comprises at least one first and at least one second lateral connecting portion (55, 56), the second portion (54) being interposed between the first lateral connecting portion (55) and the central connecting portion (53), while the second lateral connecting portion (56) is connected to either the first lateral connecting portion (55) or the first lateral connecting portion (52), each of said portions (52, 53, 54, 55, 56) comprises at least two opposing longitudinal edges and two opposing end edges, said portions (52, 54), central connecting portion (53) and said first and second lateral connecting portions (55, 56) being joined along longitudinal edges and aligned along a single direction of connection, a second sheet (57) connected to an end edge of the first portion (52), the second sheet (57) comprises a first and second portions (58, 59) joined in a single piece, wherein the first portion (58) of the second sheet (57) is interposed between the first portion (52) of the first sheet (51) and the second portion (59) of the second sheet (57), wherein the process comprises the steps of:

folding the first sheet (51) along said longitudinal edges so that the first portion of the side connection (55) is arranged at the first portion (52), joining, for example by gluing, the second portion of side connection (56) with said first portion (52) to define said storage (2), folding said first and second portions (58, 59) of the second sheet (57) to form the closure portion (9) and inserting portion (10) of the closure system, respectively.

In an aspect according to any one of the preceding aspects of process, the blank further comprises a third sheet (60) connected to an end edge of the second portion (54) of the first sheet (51), the third sheet (60) comprising a first portion and a second portion (61, 62) which are respectively configured to define the second and first panels (13*b*, 13*a*) of the second coupling portion (13), wherein the process further comprises the following steps:

folding the third sheet (60) above the second portion of the first sheet (51), joining the third sheet (60) to said second coupling portion (54) of the first sheet (51) to define the second coupling portion (13).

In an aspect according to any one of the preceding aspects of process the first portion (61) of the third sheet is interposed between the second portion (62) of the third sheet and the second portion (54) of the first sheet, wherein the step of folding the third sheet comprises the following sub-steps:

folding the second portion (62) of the third sheet above the first portion of the third sheet, optionally constraining, for example by gluing, said first and second portions (61, 62) of the third sheet, folding said first and second portions (61, 62) of the third sheet above the second portion (54) of the first sheet (51), constraining, for example by gluing, at least one of the first and second portions (61, 62) of the third sheet to the second portion of the first sheet (51), so that the first portion (61) of the third sheet may define the second panel (13*b*) whereas the second portion (62) of the third sheet may define the first panel (13*a*), wherein the second portion (54) of the first sheet (51) defines the lateral wall of the storage directly carrying the second coupling portion.

In an aspect according to any one of the preceding aspects of process the second portion (62) of the third sheet (60)

comprises a notch (62*a*) configured to define a through notch suitable for defining-following the folding of the third sheet (60)—the through opening of the first panel (13*a*). In an aspect according to any one of the preceding aspects of process the first portion (61) of the third sheet (60) comprises at least one second notch (61*a*) configured to define on the first portion of the third sheet:

at least one side shoulder, at least one central body joined in a single piece to said side shoulder and movable relatively to the latter due to the presence of said second notch (61*a*), wherein, as a result of folding the third sheet (60), the central body is configured to define the second panel (13*b*).

In an aspect according to any one of the preceding aspects of process the blank (50) is entirely made of paper material. In an aspect according to any one of the preceding aspects of proceeding the third sheet (60) comprises a third portion (61*b*) joined in a single piece with the first portion (61) of the third sheet and configured to define the thrust portion (21). In an aspect according to any one of the preceding aspects of process the second portion (54) of the first sheet (51) defines the lateral wall (optionally the front wall 4*a*) of the storage directly carrying the second coupling portion (13). In an aspect according to any one of the preceding aspects of process the notch (62*a*) on the second portion of the third sheet (60) is configured to define the gripping edge (13*d*) of the second coupling portion (13).

In an aspect according to any one of the preceding aspects, the process comprises a step of arranging the first coupling portion (12) further comprises a step of arranging a fourth sheet (63) comprising at least one first and a second portion (64, 65) joined in a single piece with the second portion (59) of the second sheet (57) and configured to form the first and second tabs of the first coupling portion (12). In an aspect according to any one of the preceding aspects, the step of arranging the first coupling portion comprises the step of folding the second portion (65) of the fourth sheet (63) relative to the first portion (64) of the same fourth sheet (63), and optionally constraining, optionally by gluing, said first and second portions of the fourth sheet.

In an aspect according to any one of the preceding aspects, the first portion (58) of the second sheet (57) comprises at least one notch (69) configured to define through access (26).

In an aspect according to any one of the preceding aspects of process only as a result of the overlapping, by folding action, of the first and second portions (61, 62) of the third sheet the seat (40) of the second coupling portion (13) is obtained. In an aspect according to the preceding aspect, the folding step of the third sheet (60) comprises the steps of:

folding the second portion (62) of the third sheet over the first portion (61) of the third sheet, constraining, for example by gluing, the second portion (62) of the third sheet (60) onto the first portion (61) of the third sheet, jointly folding the first and second portions of the third sheet (60) onto the second portion (54) of the first sheet, constraining, for example by gluing, the first portion of the third sheet (optionally exclusively the first portion 61) to the second portion (54) of the first sheet.

In an aspect a method of closing the container (1) according to any one of the preceding aspects is provided. In an aspect according to any one of the preceding aspects, the method of closing comprises the step of inserting the first coupling portion (12) into the compartment (3) of the storage (2) such that said first and second coupling portions (12, 13) are engaged to each other to define the locking condition. In an aspect according to the preceding method aspects, the method comprises inserting the first tab (12*a*) of the first coupling portion (12) into the seat (40) of the second coupling portion (13). In an aspect according to the preceding aspect, the step of inserting the first tab (12*a*) into the seat (40) of the second coupling portion (13) comprises the sub-step of inserting the first coupling portion (12) and at least part of the inserting portion into the compartment (3) of the storage by passing the first coupling portion (12) between the first panel (13*a*) of the second coupling portion and the lateral wall of the storage directly carrying said second coupling portion.

In an aspect an opening method of a container according to any one of the preceding aspects is provided. In an aspect according to any one of the preceding aspects the opening method comprises the steps of:

acting in thrust, from outside the container, on the thrust portion (21) to move at least part of the second coupling portion (13) from the blocking position to the release position to allow disengagement of the first and second coupling portions, pulling out the first coupling portion (12) from the compartment (3) of the storage (2) and consequently move the closure system (7) from the closure condition to the open condition.

In an aspect according to any one of the preceding aspects, the step of acting in thrust on the thrust portion (21) may be performed:

by inserting at least one opening device (19) through the through access (26), in between the first and second coupling portions (12, 13), manually by the user.

In an aspect according to any one of the preceding aspects, the acting in thrust on the thrust portion (21) allows the first panel (13*a*) of the second coupling portion (13) to be moved away from the lateral wall of the storage directly carrying said second coupling portion, optionally away from the front wall (4*a*). In an aspect according to any one of the aspects of opening method the manual movement of the thrust portion (21) allows the movement of said portion along at least part of the depth of the through access (26) to allow the movement of the first panel (13*a*) of the second coupling portion (13) away from the front wall (4*a*) of the storage (2).

BRIEF DESCRIPTION OF THE DRAWINGS

Some implementation forms and aspects of the invention will be described below with reference to the united drawings, provided for illustrative purposes only and therefore not limiting wherein.

DEFINITIONS AND CONVENTIONS

Figure 1:
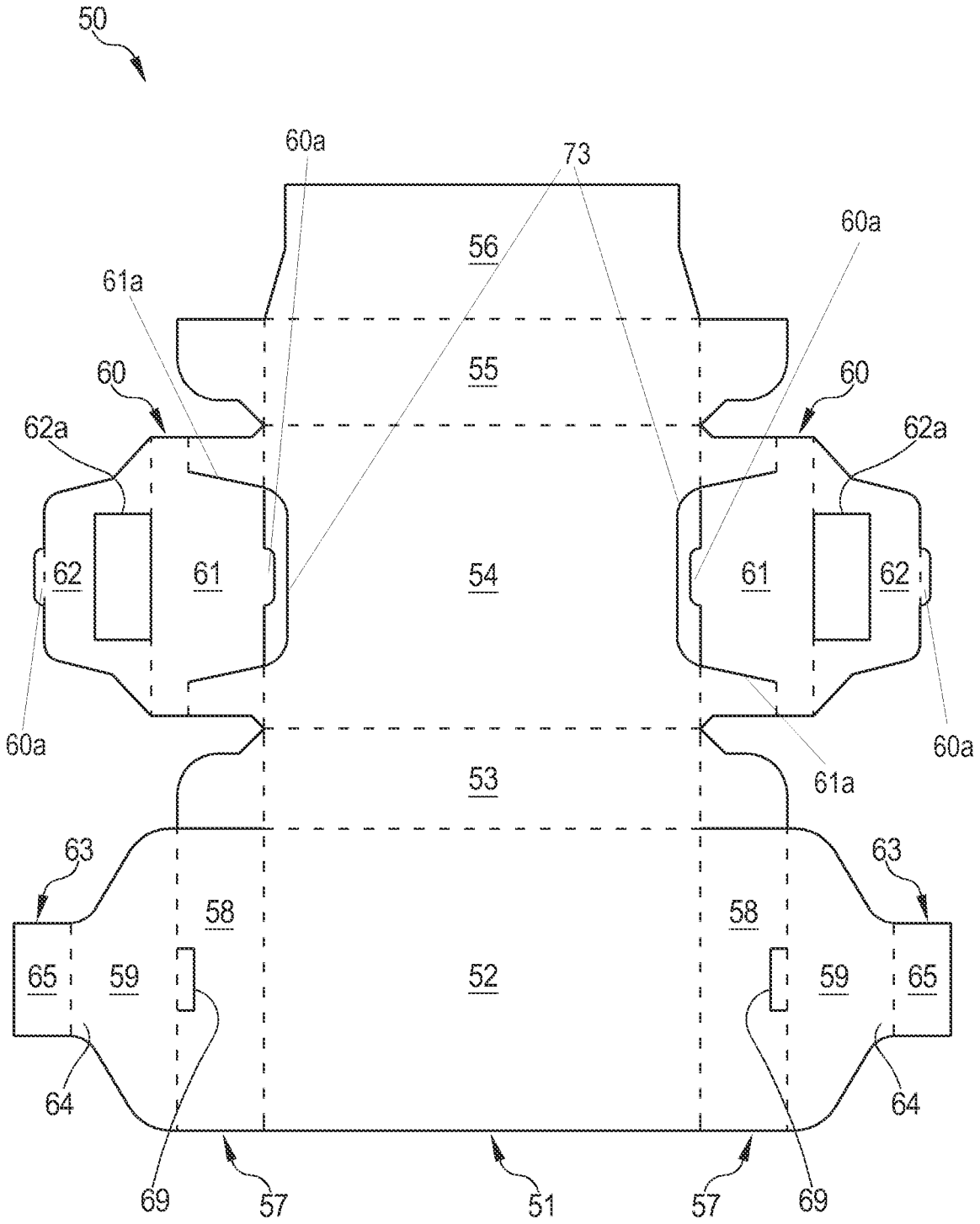
FIG. 1 shows for a blank for making a container.
Figure 2:
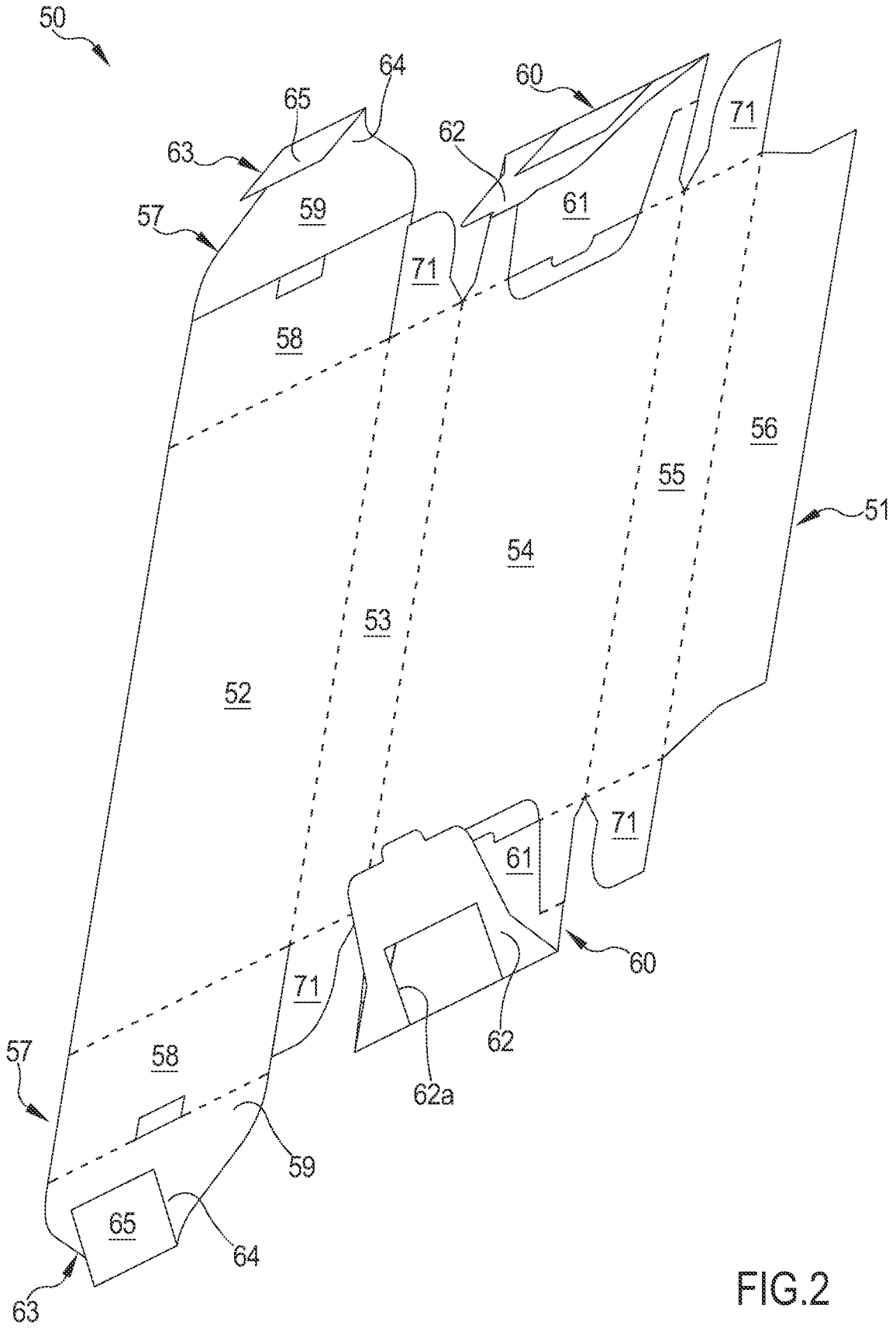
FIGS. 2 and 3 schematically show bending steps of the blank of FIG. 1 for making a container.
Figure 3:
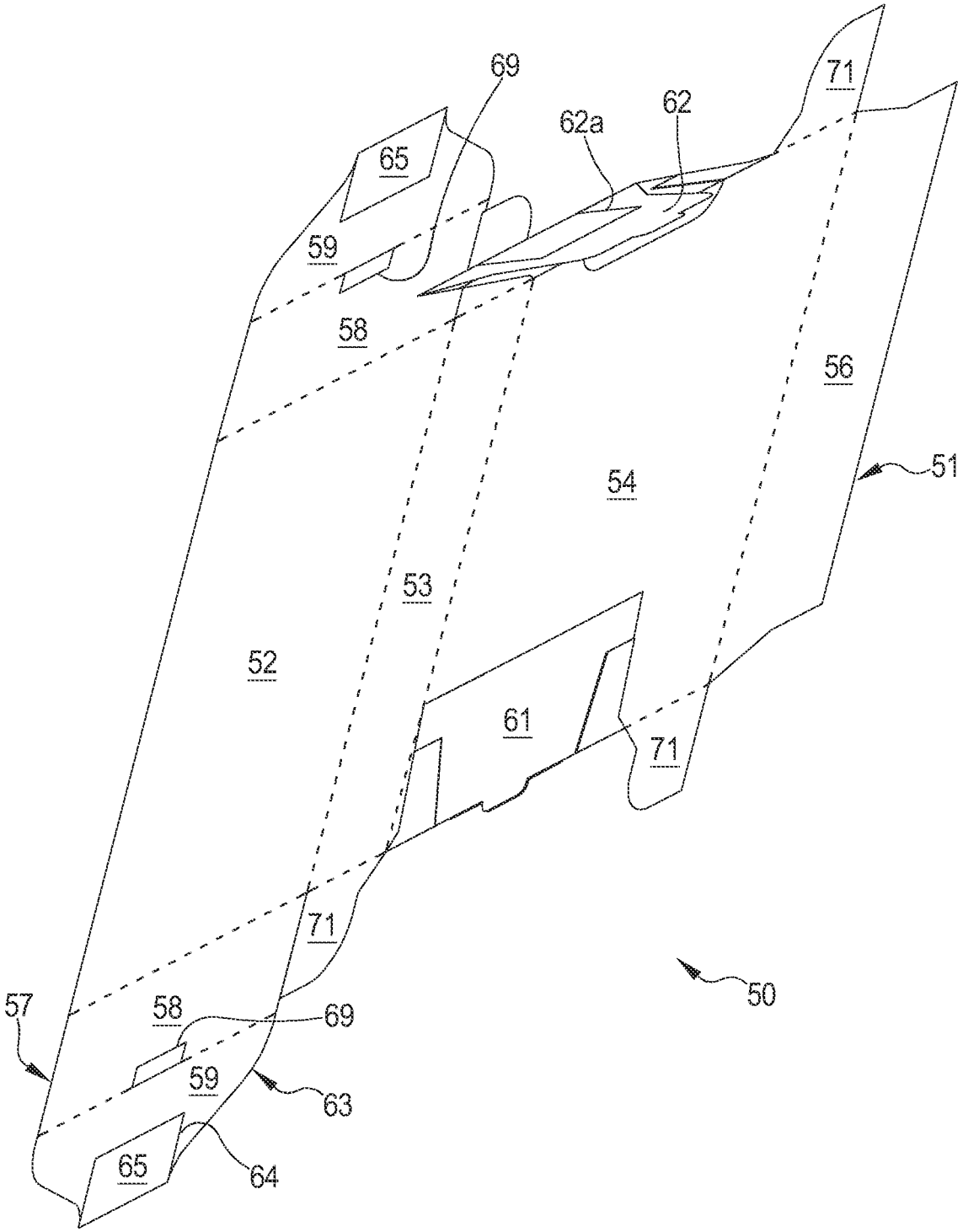

Note that in this detailed description corresponding parts illustrated in the various figures are shown with the same numerical references. The figures may illustrate the subject matter of the invention by means of representations that are not to scale; therefore, parts and components illustrated in the figures related to the subject matter of the invention may relate only to schematic representations.

The term "product" means an article or an assembly of articles of any nature. For example, product may comprise a drug, medicine, or may additionally be understood as a package, such as a blister pack, carrying a plurality of items.

The term "paper" material means paper or paperboard, for example presenting at least 50% by weight, optionally at least 70% by weight, of organic material comprises one or more of cellulose, hemicellulose, lignin, lignin derivatives. The paper material may be in sheet material presenting a weight between 100 and 500 g/m$^2$. The paper sheet material may be covered at least partially by a plastic coating, such as a film, the purpose of which is to: reinforce the paper sheet material, define a barrier to water and/or moisture. The coating may vary in thickness between 10 and 50 μm and be made of one or more of the following materials: LDPE, HDPE, PP, PE.

The term "blank" refers to a flat semi-finished product made of sheet material, such as paper material, that may be folded back on itself to make a container. The blank may be in a single-piece and obtainable by die-cutting a single sheet. The term sheet material is understood to mean a material that has two dimensions, e.g., length and width, that are significantly greater than a third dimension such as thickness.

The term "opening device" means a tool that can be used by a user to open the container. For example, the opening device may comprise at least one selected in the group from: a sheet material body (e.g., a payment card, loyalty card), an elongated body (e.g., a pen or a key). The term "manual intervention" or "manual intervention", referring to the user, means a manual action performed by the user without the use of tools, such as an opening device.

DETAILED DESCRIPTION

Container 1

With reference 1 has been indicated a child-proof container. The container 1 comprises a storage 2 in sheet material, optionally paper material, defining a compartment 3 for housing one or more products. The storage 2 comprises a predetermined number of lateral walls defining at least one passage opening 5 delimited by an edge 6 and configured to place the compartment 3 of the storage 2 in communication with the external environment. The storage 2 may have a parallelepiped shape, for example, it may have, as illustrated in the joined figures, a substantially rectangular parallelepiped shape defined by a front wall 4*a*, a rear wall 4*b* opposed to the front wall 4*a*, a first and a second lateral wall 4*c*, 4*d* opposed to each other and connected to the front and rear walls 4*a*, 4*b*. Alternatively, the storage 2 may comprises a number of walls other than four. The container 1 may comprise a single passage opening 5 in opposition of which a bottom wall configured to occlude storage 2 is present.

Alternatively, as shown in the attached figures, the storage 2 may present two passage openings 5 respectively defined at opposing longitudinal ends of the storage 2. Each passage opening 5 is delimited by a respective edge 6; in such a configuration, the storage essentially defines a tube laterally delimited by walls 4*a*, 4*b*, 4*c*, 4*d* and open at opposing longitudinal ends. However, the possibility of making, for example, a storage 2 having a single passage opening 5 or a number of openings 5 greater than two is not excluded.

Figure 9:
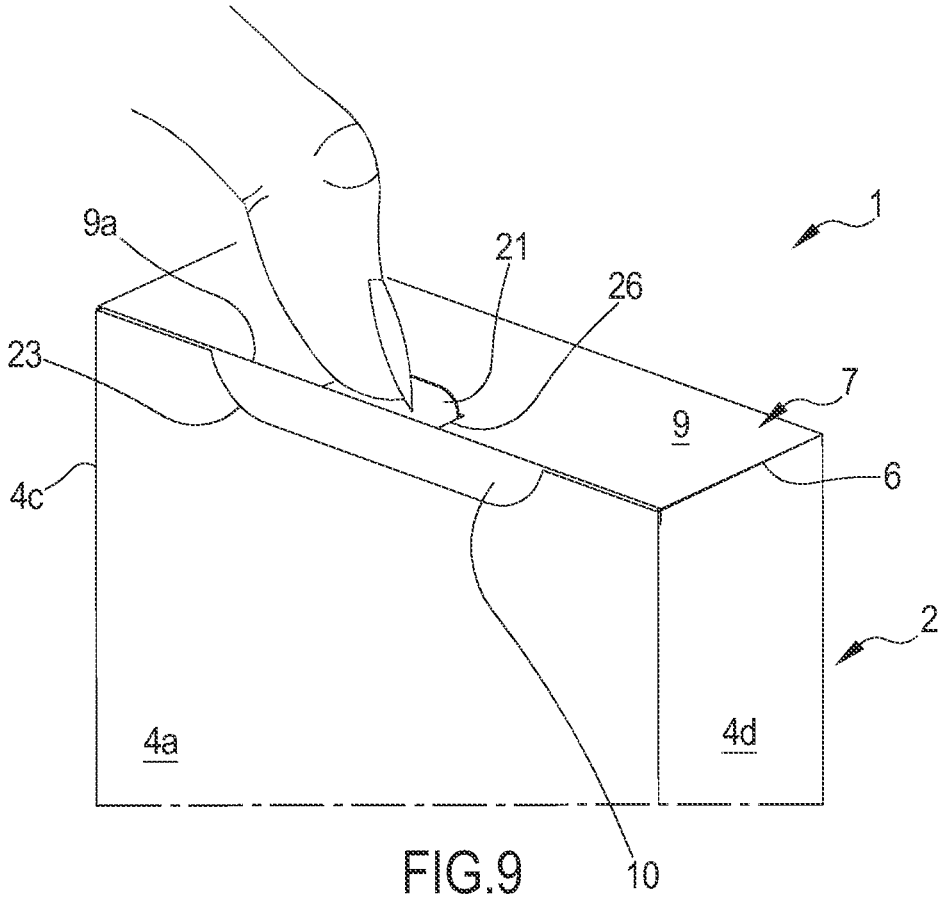
FIGS. 9 and 10 show a container during one step of opening the container, optionally by manual intervention of a user (FIG. 9) and by the use of an opening device.
Figure 10:
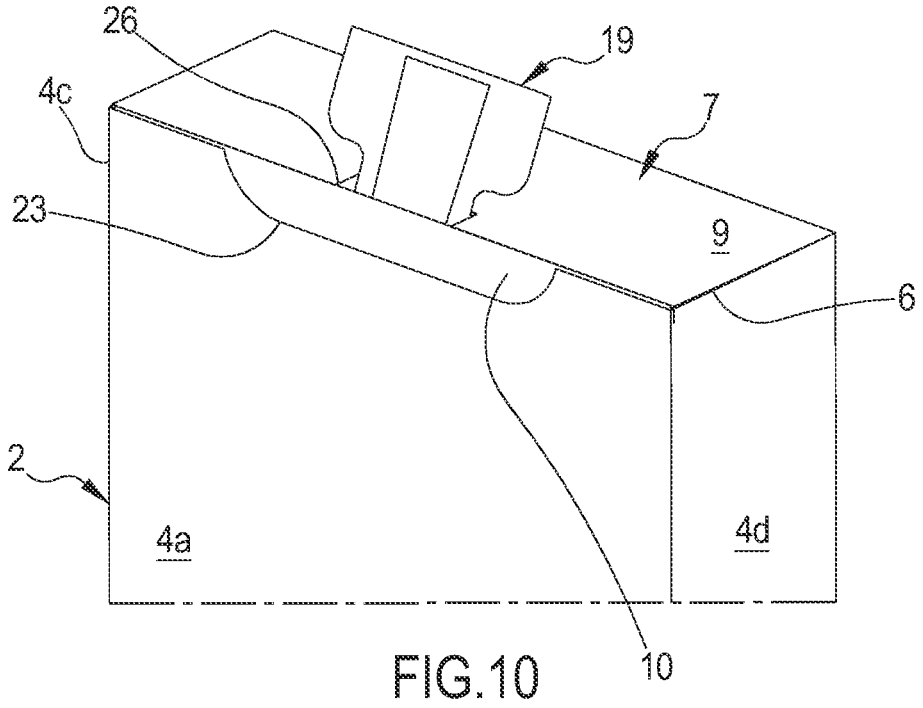

The front wall 4*a* may comprise a lowering 23 (FIGS. 9 and 10) defined at edge 6 and configured to allow a user to grip on a closure system 7 (described below) to allow the container 1 to be opened. Specifically, front wall 4*a* may comprise a lowering 23 defined at each passage opening 5. The lowering 23 may have a substantially "C," "U," or "V" shape.

Figure 4:
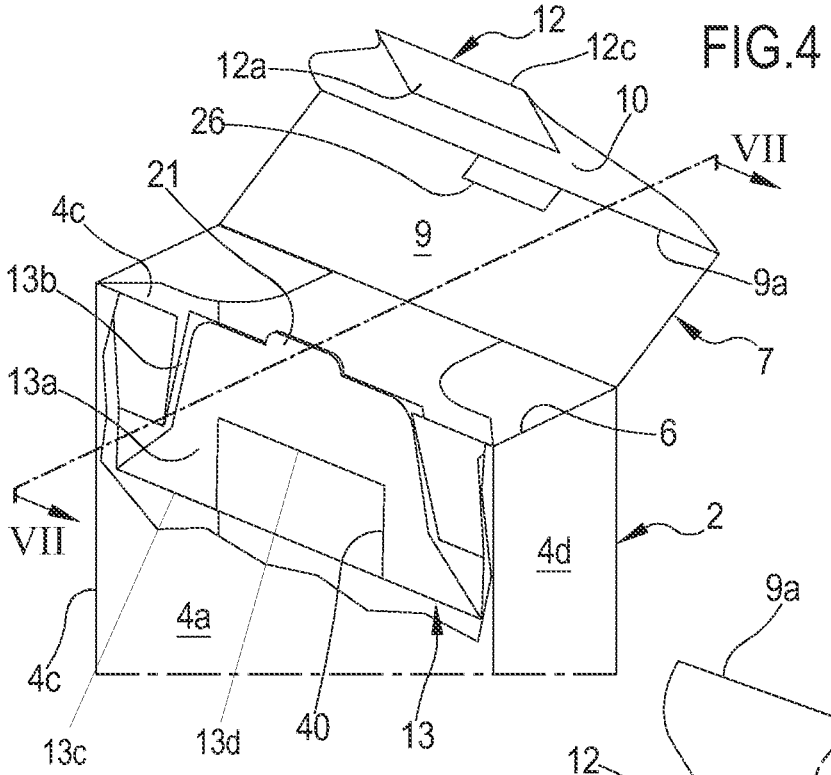
FIG. 4 is a cutaway perspective view of a container in an open condition.

As mentioned above, the container 1 also comprises at least one closure system 7 in sheet material, optionally paper material, engaged at edge 6 and movable, e.g., by rotation, relative to the storage 2. The closure system 7 is configured to define at least one closure condition (see, for example, FIGS. 6, 8, 9, and 10) where the closure system 7 itself interdicts the communication between the compartment 3 of the storage 2 and the external environment, and at least one open condition (see, for example, FIGS. 4 and 7) where closure system 7 allows communication between the compartment 3 of the storage 2 and the external environment. The container 1 may comprise a closure system 7 for each passage opening 5 of the storage 2. In the configuration of container 1 presenting two passage openings 5, said container 1 has two closure systems 7 engaged at respective longitudinally opposed edges 6 of the storage 2. The closure systems 7 are therefore arranged in opposition to each other with respect to storage 2 itself. Each closure system 7 may be joined in a single piece with the storage 2. In the attached figures, each closure system 7, in a non-limiting way, is joined in a single piece with the edge 6 and is movable by rotation around it at least between the closure condition and the open condition.

Alternatively, the closure system 7 may be removably engaged to the storage 2. Specifically, the closure system 7 may have a plurality of lateral walls defining a compartment that is countershaped to the passage opening 5 and configured to house at least part of the storage 2. Thus, the closure system 7 prevents the insertion and withdrawal of products from the storage.

In greater detail, the closure system 7 may comprise a closure portion 9 made of sheet material directly engaged and joined in a single piece with the edge 6 of the storage 2: in detail, the closure portion 9 may be directly hinged to the edge 6. The closure portion 9 is configured to interdict, in the closure condition, access to the compartment 3. The closure portion 9 may have a rectangular perimeter edge, countershaped to the edge 6. At least part of the perimeter edge of the closure portion 9 may have a sawtooth shape, configured to discourage a child from inserting a finger into the container.

The closure system 7 may also comprise an inserting portion 10 configured to insert, in the closure condition, into the compartment 3 of the storage 2. The inserting portion 10 is joined in a single piece with the closure portion 9 and emerges from the latter on the opposite side from the edge 6. The inserting portion 10 extends from the closure portion 9: in the closure condition, the inserting portion 10 is completely positioned in the compartment 3, directly facing the lowering 23. The inserting portion 10 may also be defined by a flat sheet having a substantially rectangular outline.

Figure 5:
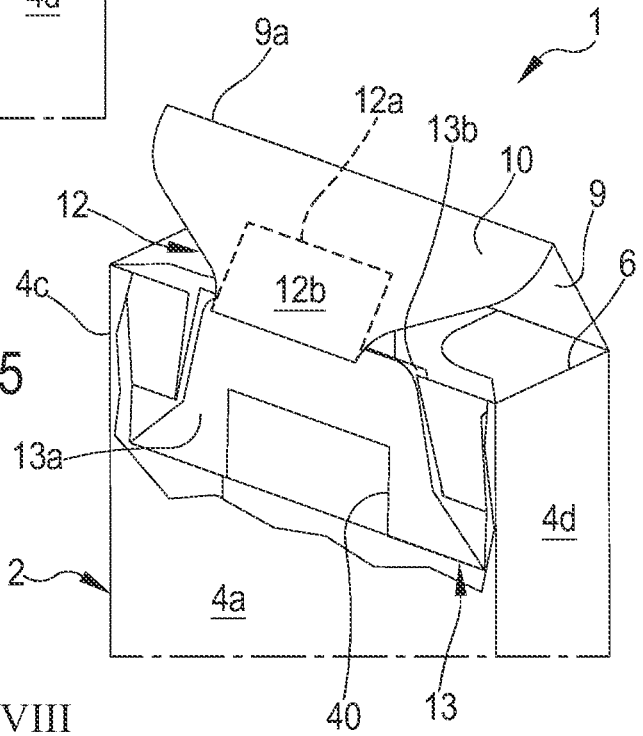
FIG. 5 is a cutaway perspective view of the container of FIG. 4 during the movement from the open condition to a closure condition.

The inserting portion 10 may be connected to the closure portion by a fold edge 9*a*, opposite the edge 6 of the storage 2 with respect to the closure portion 9 itself: the inserting portion 10 may then be movable by rotation relative to the closure portion 9 around the fold edge 9*a*. The inserting portion 10, in the closure condition, is configured to define, according to a cross-section and in cooperation with the closure portion 9, an substantially "L-shaped" outline (see, for example, FIGS. 4 and 5).

Figure 7:
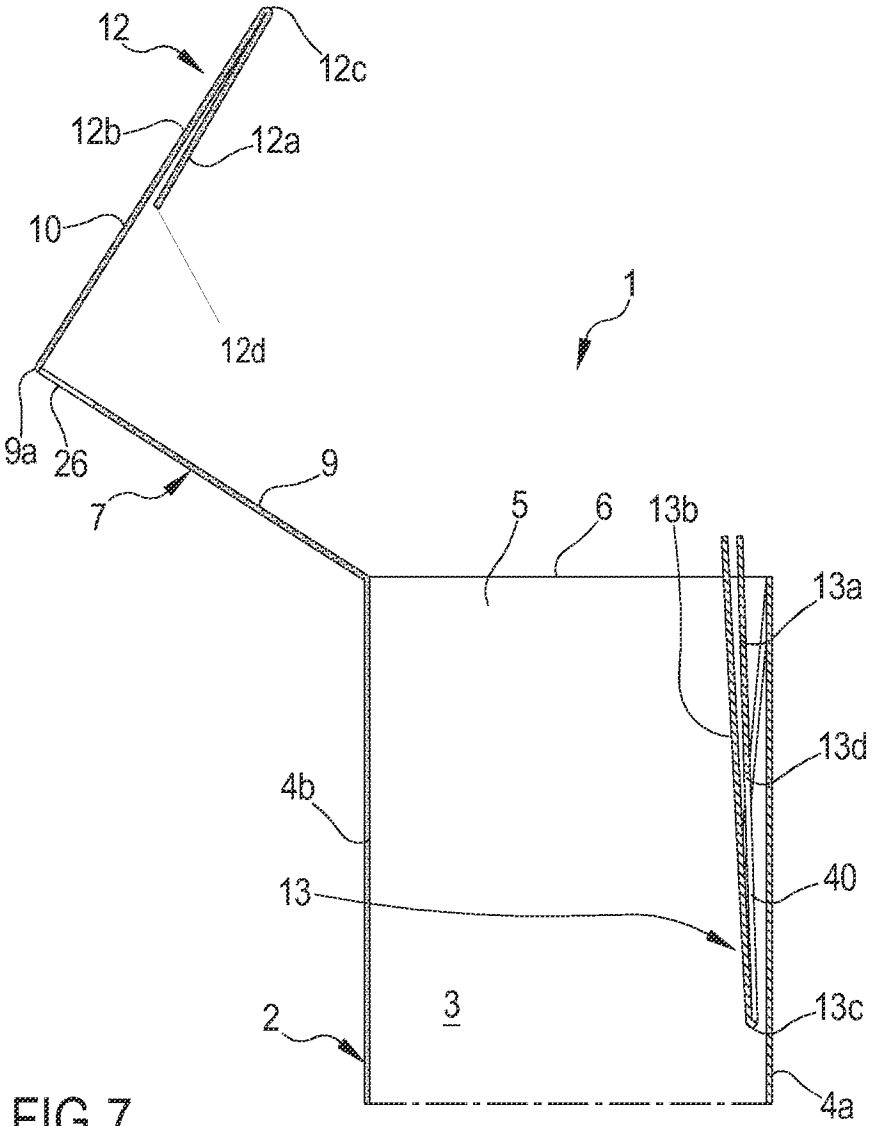

In detail, as shown in FIG. 7, the closure system 7 may be directly constrained, optionally hinged, to the rear wall 4*b*; the closure portion 10, in the closure condition, extends substantially parallel to the front wall 4*a* of the storage 2.

The inserting portion 10 may have at least one gripping portion configured to allow a user, at least in the closure condition of the container 1, grasping the closure system 7 to extract the inserting portion 10 from the compartment of the storage 2. The gripping portion may emerge, at least during the locking condition, from the edge 6 of the storage resulting in, at least during the locking condition, and being at least partially facing a thrust portion 21, the latter described below. The gripping portion of the inserting portion 10 is arranged at the edge 6; in detail, the gripping portion is defined at the lowering 23: the lowering 23 provides space for the user to grasp the gripping portion and thereby allow the closure system 7 to be moved from the locking condition to the open condition. The gripping portion, in the closure condition of the closure system 7 of the container, may alternately emerge from the edge 6 to define a protrusion of the closure system 7 that can be grasped by the user in the closure condition of the container.

The gripping portion is in a single piece with the inserting portion 10 and is free of weakenings configured to allow facilitated breaking of at least one of said inserting portion 10 and gripping portion: the inserting portion 10 and the gripping portion lie on a single plane of development.

As shown from the attached figures, the container 1 also comprises a through access 26 defined on the closure system 7, specifically defined, in the closure condition, at the edge 6 of the storage 2. The through access 26 may be defined entirely on the inserting portion 10; in such a configuration, the through access 26 extends from the fold edge 9*a* toward a central area of the inserting portion 10 to define a depth of said through access 26; the ratio of the depth of the through access 26 to a depth of the inserting portion 10, measured along the depth of the through access 26, may be between 0.3 and 1. In such a configuration, at least one section of the through access 26 may be delimited by the gripping portion of the inserting portion 10.

The through access 26 may be entirely defined on the closure portion 9 (see, for example, FIGS. 4, 6-10); the through access 26 may then extend from the fold edge 9*a* toward a central area of closure portion 9 (toward edge section 6 delimited by rear wall 4*b*) to define a depth of said through access 26; the ratio of the depth of through access 26 to a depth of closure portion 9, measured along the depth of through access 26, is between 0.15 and 0.4. In such a configuration, at least one section of the through access 26 may be delimited by the gripping portion of the inserting portion 10. The through access 26 has a predetermined width measured along a direction parallel to fold edge 9*a* of the closure system 7; the ratio between the width of through access 26 and a width of closure portion 9, measured along the width of through access, is between 0.15 and 0.5, optionally between 0.2 and 0.45.

The through access 26 may also be defined at least in part on the inserting portion 10 and at least in part on the closure portion 9; said through access 26 comprises a single opening passing the thickness of closure system 7 and delimited by a single closed-profile perimeter edge; in detail, through access 26 is arranged entirely within an outer perimeter edge of closure system 7. The through access 26 may be substantially square or rectangular in shape (see, for example, FIG. 4) or substantially "T-shaped," or it may have a connected outline.

The through access 26 is configured to allow a user to reach in the compartment 3 of the storage 2 to allow it to be opened. The through access 26 is also configured to allow a user, from the outside the container, to grasp the inserting portion 10 and/or push on the gripping portion of the closure portion 9 to allow the closure system 7 to be moved from the closure condition to the open condition; in fact, the through access 26 is also configured to allow the inserting portion to be pulled out of the compartment 3 of the storage 2 to allow the container 1 to be opened.

The container 1 also comprises at least one first coupling portion 12 carried by the closure system 7 and at least one second coupling portion 13 carried by the storage 2. The first and second coupling portions 12, 13 are configured to engage each other during a closure condition (see, for example, FIGS. 6 and 8) to define a locking condition of the container where the opening of the container is prevented. In detail, in the closure condition, the first coupling portion 12 is configured to fit at least partially into the compartment 3 of the storage 2 to engage to the second coupling portion 13.

Figure 6:
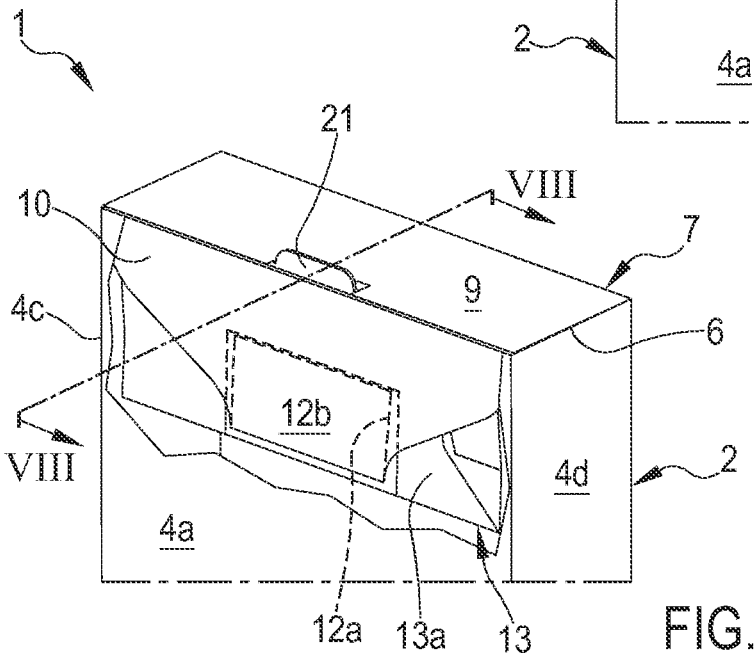
FIG. 6 is a cutaway perspective view of the container of FIG. 4, arranged in a closure condition.
Figure 8:
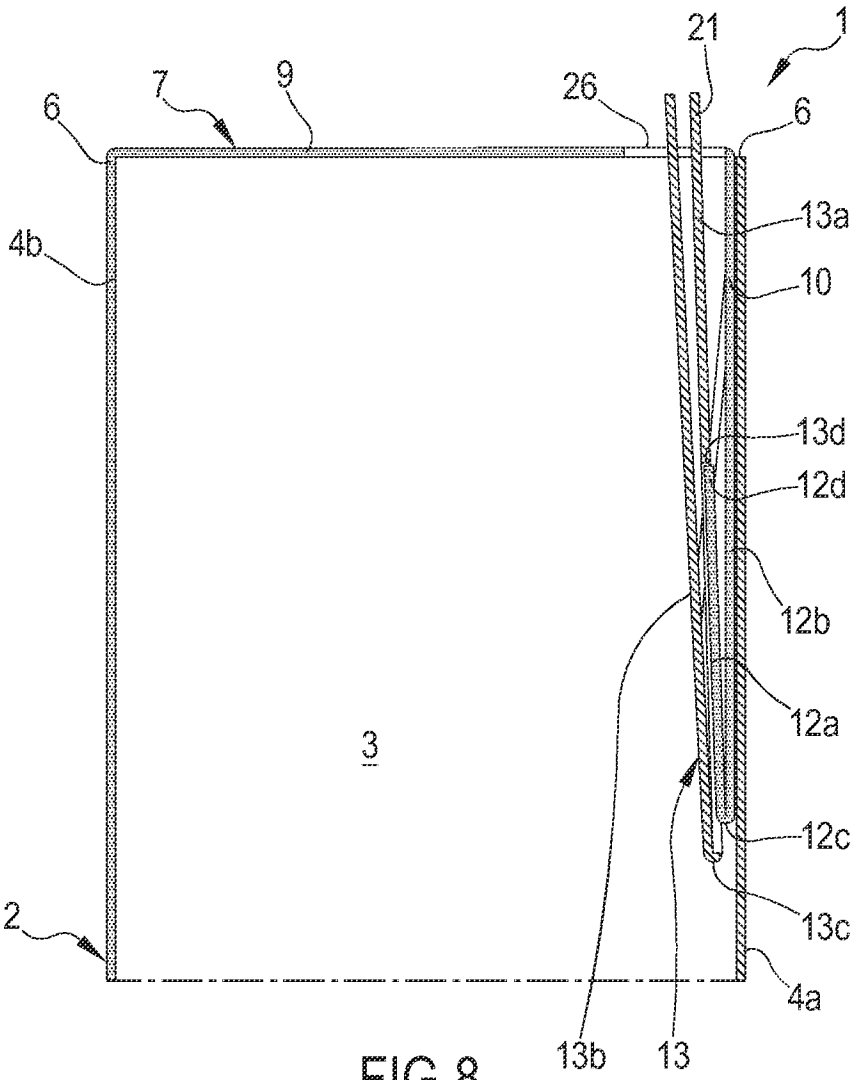
FIGS. 7 and 8 are cross-section views of a container in an open condition (FIG. 7) and a closure condition (FIG. 8)

As illustrated for example in FIGS. 6 and 8, in the closure condition, the first coupling portion 12 is fully contained in the compartment 3 of the storage 2, spaced from edge 6. Also, in the closure condition, the engagement between the first and second coupling portions 12, 13 is fully defined in the compartment 3 of the storage 2. The engagement between the first and second coupling portions 12, 13 is reversible; in other words, subsequent to reaching the open condition, the first and second coupling portions 12, 13 may be engaged to define the closure condition again and, consequently, a new locking condition. This is possible because, upon switching between the closure condition and the open condition, the first coupling portion 12 is disengaged from the second coupling portion 13: the first and second coupling portions 12, 13 are not removed or detached from the closure system 7 and the storage 2, respectively, but remain engaged to the latter. Thus, since no removable or weakened portions are provided in association with said first and second coupling portions 12, 13, they are configured to reversibly define, following each open condition, a locking condition wherein said portions 12, 13 are stably engaged with each other.

The second coupling portion 13 is directly engaged to a lateral wall of the storage 2, specifically constrained to front wall 4*a*. The second coupling portion 13 may define at least part of the lateral wall of the storage 2, i.e., define the sheet that defines at least part of the outer surface of the container. Alternatively, as shown in the attached figures, the second coupling portion 13 may be arranged at least partially in the storage 2 in both the closure system and the open condition. The second coupling portion 13 is in sheet material, optionally in paper sheet material.

The second coupling portion 13 comprises at least one panel directly carried by the storage 2, optionally from the front wall 4*a*, on which is defined at least one opening delimited at least in part by a gripping edge 13*d* (FIGS. 4 to 8) configured to engage, in the closure condition, the first coupling portion 12 to define said locking condition. In particular, the at least one panel of the second coupling portion 13 is facing and at least partially contacting the lateral wall of the storage 2 directly carrying said second coupling portion 13, optionally to the front portion 4*a*.

As can be seen, for example, FIG. 7, the opening defined on the second coupling portion 13 passes through said at least one panel; said opening is delimited by a perimeter edge which may have a substantially polygonal outline, optionally rectangular: the gripping edge 13*d* delimits at least part of said opening, optionally the through opening, defined on the second coupling portion 13 and is spaced apart from the edge 6 of the storage 2. In more detail, the gripping edge 13*d* is placed in the compartment 3 of the storage 2, optionally in both the closure condition and the open condition of the closure system 7: the gripping edge 13*d* of the second coupling portion 13 may have a rectilinear (FIG. 4) or "C" or "V" shape. Still more in detail, the gripping edge 13*d* may extend along a rectilinear direction that is substantially parallel to a lying plane of the edge 6 of the storage.

Functionally, the second coupling portion 13, although constrained to the storage wall (e.g., to front wall 4*a*), is movable at least partially relative to the storage 2 at least between:

- a blocking position where the second coupling portion 13 is configured to engage the first coupling portion 12, and
- a release position where the second coupling portion 13 is configured to disengage the first coupling portion 12 to allow the closure system 7 to switch from the closure condition to the open condition.

The gripping edge 13*d*, in the blocking position, is placed at a distance from the front wall 4*a* of the storage 2 that is less than a distance present between said gripping edge 13*d* and lateral wall 4*a* when the second coupling portion 13 is in the release position. In fact, the panel of the second coupling portion 13 is tilted so as to intercept and block the first coupling portion 12 (blocking position) and release said second coupling portion (release position) to allow the container to be opened. In detail, the at least one panel of the second coupling portion 13 lies on a plane which, in the blocking position, is substantially parallel to a lying plane of the lateral wall of the storage directly carrying said second coupling portion 13, optionally it is parallel to a lying plane of the front wall 4*a* directly carrying said second coupling portion 13; the lying plane of the at least one panel of the second coupling portion 13, in the release position, is tilted with respect to a lying plane of the lateral wall of the storage directly carrying said second coupling portion 13 (optionally it is tilted with respect to a lying plane of the front wall 4*a*), for example by an angle is 1° above, optionally it is between 2° and 20°, even more optionally it is between 2° and 15°.

The second coupling portion 13 may comprises only one panel entirely placed in the compartment 3, or it may define part of the storage lateral wall, specifically defining part of the outer surface of the storage 2.

A second coupling portion 13 comprising a first and second panel 13*a*, 13*b* has been shown in the attached figures; the first panel 13*a* comprises said at least one opening delimited at least in part by said gripping edge 13*d* while the second panel 13*b* faces the first panel 13*a*.

The second panel 13*b* may be joined in a single piece to the front wall 4*a* of the storage and arranged entirely in the compartment 3, directly facing the front wall 4*a*. Only the first panel 13*a* comprises the through opening: the first panel 13*a* is configured to receive in insertion at least a portion of the first coupling portion 12 to allow it to be engaged with the second coupling portion 13. In detail, the through opening is delimited by an open-profile perimeter edge, optionally at least partially countershaped to the first coupling portion 12: the through opening is delimited at least partially (optionally superiorly) by the gripping edge 13*d*, also arranged entirely in the storage 2, distinct and spaced from the edge 6. The gripping edge 13*d* of the first panel 13*a* substantially defines the portion of the second coupling portion configured to abut and engage the first coupling portion 12.

The second panel 13*b* is engaged to the first panel 13*a* such that the latter is interposed between the lateral wall of the storage directly carrying the second coupling portion (e.g., front wall 4*a*) and the second panel 13*b*. The second panel 13*b* is disposed at the through opening of the first panel 13*a*, extending along a direction parallel to the latter: the second panel 13*b* is disposed at the through opening of the first panel 13*a* to define, in cooperation with said through opening of the first panel 13*a*, a seat 40 configured to house, during the open condition of the closure system 7, at least a portion of the first coupling portion 12. The seat 40 is blind, that is, it does not pass through the thickness of the entire second coupling portion 13: in fact, the second panel 13*b* defines a kind of retainer panel for the first coupling portion 12 while the first panel 13*a*, thanks to the presence of the through opening, engages the first coupling portion 12. In fact, in the locking condition, the gripping edge 13*d* of the first panel 13*a* abuts the first coupling portion (FIG. 8).

The second panel 13*b* may be joined in a single piece with the edge defined by the front wall 4*a* of the storage and folded around said edge 6; the second panel 13*b* may also be joined in a single piece with the first panel 13*a* and folded over the latter to define a folded portion (see, for example, FIGS. 4-8): the second panel 13*b*, overlapped to the first panel 13*a*, is constrained, for example, by gluing, to the first panel 13*a*. The first and second panels 13*a*, 13*b* may be joined and folded at a fold edge 13*c*, located in compartment 3, spaced from the edge 6; the fold edge 13*c* is also spaced from gripping edge 13*d*. In addition to being joined and folded with respect to each other, the first and second panels 13*a*, 13*b* may be joined, e.g., by gluing, at fold edge 13*c*, or at an area peripheral to the seat 40; in fact, first and second panels 13*a*, 13*b* are parallel and movable solidly with respect to storage 2. Additionally, at least one of the first and second panels 13*a*, 13*b* may be constrained, for example by gluing, the lateral wall of the storage directly carrying the second coupling portion 13, in particular to the front wall 4*a*.

At least part of the first and second panels 13*a*, 13*b* of the second coupling portion 13 are movable relative to the storage at least between:

- the blocking position where the first and second panels 13*a*, 13*b* are placed against the front wall 4*a* of the storage 2, configured to allow, in cooperation with the front wall 4*a*, locking of the first coupling portion 12 into the seat 40,
- the release position where the first and second panels 13*a*, 13*b* are at least partially spaced from the front wall 4*a* to allow the first coupling portion 12 to be pulled out of the seat 40.

In particular, both the first panel 13*a* and the second panel 13*b* are movable at least between the blocking position and the release position, and vice versa, to allow the movement of the first coupling portion 12 outside the seat 40.

As can be seen from the attached figures, the seat 40 has a substantially "C"- or "U"-shaped conformation, delimited at least in part by the gripping edge 13*d* of the first panel 13*a*: the seat 40 may therefore also be countershaped to at least part of the first coupling portion 12. The container is opened as a result of lifting and extracting the first coupling portion 12 from seat 40 to allow the inserting portion 10 to be extracted from the compartment 3 of the storage 2.

The second coupling portion 13 may comprise a thrust portion 21 placed at the through access 26; the thrust portion 21 is configured to allow movement of at least part of said second coupling portion 13 itself from the blocking position to the release position. In detail, the thrust portion 21, in the closure condition of the closure system 7, is configured to allow a user to act, from outside the container, in thrust on the thrust portion 21 itself to move the first and second panels 13*a*, 13*b* from the blocking position to the release position to disengage the first and second coupling portions 12, 13. The through access 26 is configured to allow access to the compartment 3 of the storage 2, as well as to allow a user to act on the thrust portion 21 to allow disengagement of the first and second coupling portions 12, 13 and thus switching the closure system 7 from the closure condition to the open condition. In other words, the through access 26 is thus configured to allow a user, from outside the container, to move the first and second panels 13*a*, 13*b* from the blocking position to the release position due to the thrust portion acting, as will be better described below, as a useful element for direct movement from the second coupling portion 13 or as a guide element of at least one opening device 19.

The thrust portion 21 may be directly carried by the first and/or second panels 13*a*, 13*b*; in detail, the thrust portion is at least carried/defined on the first panel 13*a* of the second coupling portion 13: the thrust portion 21 lies on a development plane substantially parallel, optionally coincident, with the development plane of the first panel 13*a*. The first panel 13*a* and the thrust portion 21 define a single tab in sheet material, optionally paper material. In fact, thrust portion 21 emerges from the first panel 13*a*, in the closure condition of the container, in the direction of closure system 7.

Thrust portion 21, at least during the closure condition of the closure system 7 may:

- pass through at least part of said through access 26, optionally emerging from at least part of the container (FIG. 6). In such a configuration, the thrust portion 21, in the closure condition of the closure system 7, passes through at least part of through access 26, emerging from the compartment 3 of the storage 2; or
- face said through access 26, without crossing it.

Regardless of the position and extension of the thrust portion 21, the same may be configured to allow a user, in the locking condition and from outside the container, to intervene manually and/or by means of an opening device 19 on the thrust portion 21 to allow the displacement of at least part of the second coupling portion 13 from the blocking position to the release position: the thrust portion 21 is solidly movable with the first and/or second panel 13*a*, 13*b* at least between the blocking position and the release position, and vice versa.

In fact, the thrust portion 21 is then configured to allow the tilting of the first panel 13*a* from the blocking position to the release position, to distance the gripping edge 13*d* from the lateral wall of the storage directly carrying the second coupling portion (e.g., front wall 4*a*) and to allow the release of the first coupling portion 12.

In the attached figures, a thrust portion 21 is illustrated, in a non-limiting way, that, in the locking condition, passes through the through access 26 and exits the container 1. In such a configuration, the thrust portion 21 may be moved, in the locking condition, manually by a user (see, for example, FIG. 9) to move the second coupling portion 13 from the blocking position to the release position, or it may substantially define a guide portion suitable for receiving in support an opening device 19 (FIG. 10) to guide it in interposition between the first coupling portion 12 and at least a portion of the second coupling portion 13 to allow the first coupling portion 12 to be extracted from the seat 40.

In such a condition, the thrust portion 21, in the closure condition, passes through the through access 26 and protrudes partially from the closure system 7 by a predetermined height. In particular, the thrust portion 21 protrudes from the edge 6 by a length equal to the predetermined height, which is a fraction of the predetermined extent of the same thrust portion 21. In fact, the thrust portion 21 is at least partly arranged in the compartment 3 and partly arranged outside the storage: the ratio of the height of the thrust portion 21 emerging from the edge 6 of the storage 2 to the extent of the thrust portion itself is greater than 0.1, optionally between 0.3 and 0.8. In other words, the height of the thrust portion 21 emerging from edge 6 is greater than 2 mm, optionally ranging between 3 mm and 10 mm.

Alternatively, the thrust portion 21 may be arranged entirely in the compartment 3 of the storage 2 and arranged, in the locking condition, facing the through access 26 (condition not illustrated): in such an embodiment, the thrust portion 21 does not cross the through access 26. In such a condition, the through access 26 is configured to allow a user to insert a finger or an opening device 19 at least partially into the compartment 3 of the storage 2 and act on the thrust portion 21 to allow at least part of the second coupling portion 13 to be moved from the blocking position to the release position and the first coupling portion 12 to be pulled out of the seat 40.

As described above, the first coupling portion 12 is configured to constrain the gripping edge 13*d* of the first panel 13*a* to define the locking condition. In the closure condition of the closure system 7, the first coupling portion 12 is at least partially arranged in the seat 40 to define the engagement between the first and second coupling portions 12, 13; the opening of the container 1 occurs as a result of the extraction of the first coupling portion 12 from the seat 40, allowing it to disengage with the gripping edge 13*d* of the first panel 13*a* of the second coupling portion 13. This extraction phase of the first portion 12 is initiated by the movement of the thrust portion 21 (manually or by means of the opening device) and subsequently performed by the user due to the push/pull by the user on the closure system 7.

Dimensionally, thrust portion 21 has a predetermined thickness measured along a direction orthogonal to fold edge 9*a*. The ratio of the thickness of thrust portion 21 to a through access depth 26, is between 0.01 and 0.1.

The first coupling portion 12 is joined in a single piece with the closure system 7, for example, directly carried by the inserting portion 10. In detail, the first coupling portion 12 and the inserting portion 10 may be joined in a single piece to form a single body. The first coupling portion 12 may extend seamlessly from the inserting portion 10 and be placed opposite to the closure portion 9 with respect to said inserting portion 10: the inserting portion 10 is thus interposed between the closure portion 9 and the first coupling portion 12.

The first coupling portion 12 comprises a first and second tabs 12*a*, 12*b* made of sheet material, optionally paper material, at least partially overlapping each other; in more detail, the first and second tabs 12*a*, 12*b* are at least partially facing each other. In still greater detail, the first tab 12*a* entirely overlaps and constrains, optionally by gluing, the second tab 12*b*: the first and second tabs 12*a*, 12*b* are parallel to each other.

As shown from the attached figures, the first and second tabs 12*a*, 12*b* may be in one piece and be defined by a folded portion: the first tab 12*a* may in fact be joined in a single piece with the second tab 12*b* and folded over the latter at a fold edge 12*c*. In particular, the second tab 12*b* extends seamlessly from the inserting portion 10 whereas the first tab 12*a* is folded over the second tab 12*b*; at least the first tab 12*a*, in the closure condition, is arranged at least partially in the seat 40, optionally in the compartment 3. In detail, at least the first tab 12*a* of the first coupling portion 12, in the locking condition, is engaged at the gripping edge 13*d* of the second coupling portion 13 to define said locking condition.

As seen for example in FIG. 7, the first tab 12*a* defines a support edge 12*d* which, in the locking condition (FIG. 8), is engaged at the gripping edge 13*d* of the second coupling portion 13, optionally at the gripping edge 13*d* defined by the first panel 13*a*. The support edge 12*d* of the first coupling portion 12, in the locking condition, is spaced from edge 6, optionally entirely placed in the compartment 3.

In detail, as shown in FIG. 8, the first tab 12*a*, in the locking condition, directly faces the second panel 13*b* of the second coupling portion 13 whereas the second tab 12*b* directly faces the lateral wall of the storage 2 directly carrying the second coupling portion 13, optionally the front wall 4*a*. The first tab 12*a* is of such a shape and size that the first tab 12*a* itself can be inserted into the seat 40; for example, the first tab 12*a* may be at least partially counter-shaped to the seat 40 of the second coupling portion 13, that is, it may be delimited by a perimeter edge having a substantially polygonal outline, optionally rectangular.

In fact, the first tab 12*a* of the first coupling portion, in the locking condition, is placed in the seat 40 of the first panel 13*a* of the second coupling portion 13, in interposition between the second tab 12*b* of the first coupling portion and the second panel 13*b* of the second coupling portion 13. Still more in detail, the first tab 12*a*, in the locking condition, is at least partially in direct contact, on one side, with the second tab 12*b* of the first coupling portion and, on the opposite side, with the second panel 13*b* of the second coupling portion 13.

Further, the second tab 12*b*, in the locking condition, is interposed between the lateral wall of the storage directly carrying the second coupling portion (optionally the front wall 4*a*) and the first tab 12*a* of the first coupling portion 12 which is engaged in the seat 40 of the first panel 13*a*. In more detail, the second tab 12*b* of the first coupling portion 12, in the locking condition, is at least partially in direct contact, on one side, with the lateral wall of the storage directly carrying the second coupling portion 13 and, on the opposite side, with the first tab 12*a* of the first coupling portion itself.

In fact, the structure of the first coupling portion 12 allows to stably engage the first tab 12*a* in the seat, a condition that allow the effective locking condition of the container in the closure condition. On the other hand, the second tab 12*b* acts as a pusher for the first tab 12*a*; in fact, the second tab 12*b*, in the locking condition, is, from one side, in contact with the lateral wall of the storage directly carrying the second coupling portion and, on the opposite side, in contact with the first tab; this configuration allows the second tab 12*b* to substantially push the first tab 12*a* into the seat 40 to ensure its stable engagement.

On the other hand, the presence of the second panel 13*b* of the second coupling portion 13 prevents the first coupling portion 12 from interlocking with the second coupling portion 13, a condition that would prevent even an adult from easily opening the container.

Wherein the second coupling portion 13 is defined in the compartment 3, the first and second tabs 12*a*, 12*b* of the first coupling portion 12, in the locking condition, are also arranged completely in the compartment 3 of the storage 2, spaced from the edge 6. The support edge 12*d* is defined by the first tab 12*a* and is opposed to the fold edge 12*c* of the first and second tabs 12*a*, 12*b* (FIG. 7).

During the opening process of the container, either by manual action or by use of the opening device, the user may directly act on the first and/or second panels 13*a*, 13*b* to allow the gripping edge 13*d* to be moved away from the support edge 12*d* of the first coupling portion so that the first tab 12*a* may disengage from the first panel 13*a* of the second coupling portion 13, thereby allowing the first coupling portions to be extracted from the compartment 3: in this way, the user may move the closure system 7 from the closure condition to the open condition.

As described above, the first and second coupling portions 12, 13 are configured to reversibly engage each other, that is, configured to re-engage each other following a disengaged condition. Both the first and second coupling portions 12, 13 are totally devoid of weakenings (e.g., notches and/or thickness reductions) configured to allow for easily breaking of the latter.

However, the container 1 may have at least one removable tab engaged to closure system 7. The removable tab is placed in at least partial closure of the through access 26 and is configured to fully separate from the closure system 7 following an attempted user intervention on the thrust portion 21. In detail, the removable tab is configured to separate from the closure system 7, in the locking condition, following an attempted intervention, manually and/or by means of the opening device 19, by the user on the thrust portion 21. Thus, the absence of the removable tab may give evidence to the user of an initial attempt to open/tamper with the container. The removable tab is located within the through access 26; the removable tab is joined of piece to the closure system 7 by at least one weakened portion, for example comprising attachment points that are easily broken as a result of an attempt to move the thrust portion 21. The weakened portion is joined to the removable tab and is configured to break as a result of intervention, optionally manually and/or by means of an opening device, on the removable portion itself. The removable tab may totally occlude the through access 26 or it may occlude only a portion of the through access 26; in fact, it is sufficient for the tab to oppose the movement of the thrust portion 21 and/or to prevent the user from reaching the thrust portion 21.

In other words, the removable tab allows at least partial obstruction of the through access 26 and/or limits the handling of the thrust portion 21; therefore, any attempt to open the container by crossing through access 26 and/or by handling the thrust portion 21 would, as the tab is structured, cause it to break and result in the user being alerted to an attempt to tamper with the container.

As described above, the disengagement between the first and second coupling portions 12, 13 may be performed by means of an aperture device 19 which may, in a non-limiting way, be part of the container 1. The aperture device 19 may be made of paper sheet material; however, the aperture device 19 may be made of additional materials, such as plastic sheet material or metal sheet material. For this purpose, the opening device 19 may be obtained by folding two overlapping layers of sheet material, presenting a stiffness substantially equal to or greater than a stiffness of the first and second coupling portions 12, 13. In detail, the opening device 19 may have a substantially "T-shaped" shape comprising an unlocking portion configured to be inserted at least partially within the through access 26 and a gripping portion configured to be gripped by a user to move the opening device within the storage. The release portion, during the closure condition, is guided by the thrust portion 21 in interposition between the first and second coupling portions 12, 13 allowing the same first coupling portion 12 to be lifted up and out. The opening device 19 may be obtained from the same blank by which the container is made. For example, the opening device may be obtained through a sheet portion of the storage 2.

The container 1 may further comprise a pocket associated with at least one of the storage 2 and the closure system 7, configured to house at least part of the opening device 19 when the latter is not arranged in insertion in the compartment 3 of the storage 2. In particular, the pocket is defined on storage 2, entirely arranged in the compartment 3. The container further comprises a slot arranged on the storage 2 and configured to allow a user, from outside the container, to reach into the pocket to withdraw or deposit the opening device 19. Through the slot and from outside the container, a user may grasp the grip portion of the opening device 19 to pick up or deposit the latter into the pocket.

Blank

Container 1 is made by a blank 50 in paper sheet material. The blank 50 may comprise a first sheet 51 having at least one first and second portions 52, 54 interconnected by a central connecting portion 53. The first sheet 51 also comprises a first side connecting portion 55 interconnected to the second portion 54. As shown in FIG. 1, the central connecting portion 53 is interposed between the first and second portions 52, 54, while the second portion 54 is interposed between the first lateral connecting portion 55 and the central connecting portion 53. Each of said portions 52, 53, 54, 55 comprises at least two opposing longitudinal edges and two opposing end edges: the portions 52, 54, the central connecting portion 53 and optionally the first lateral connecting portion 55 are joined along the longitudinal edges and aligned along a single connecting direction.

The first portion 52 of the first sheet 51 has a rectangular outline perimetrically delimited by a lower edge, a first and second side edge, and an upper edge. Similarly, the second portion 54 of the first sheet 51 has a rectangular outline perimetrically delimited by a bottom edge, a first and second side edge, and an upper edge. The first and second portions 52, 54 may comprise a sheet having substantially the same shape and size. The central portion 53 and the first side connecting portion 55 may have substantially the same shape and size and are joined in a single piece with the portions 52 and 54 of the first sheet 51.

The first sheet 51 may also comprise a second side connecting portion 56 which may be directly interconnected to the first side connecting portion 55 or may be directly carried by the first sheet portion 52. As shown in FIG. 1, the second lateral connecting portion 56 may have the same dimensions as the first lateral connecting portion 55. The end portion 56 may have smaller dimensions than the first side connecting portion 55.

The blank 50 may comprise at least one second sheet 57 joined in a single piece with the first sheet 51 at least one end edge of the first portion 52 of the first sheet 51. The second sheet 57 comprises at least one first and a second portion 58, 59 joined in a single piece with each other: the first portion 58 of the second sheet 57 is connected to the first sheet 51 such that said first portion 58 is interposed between the second portion 59 of the second sheet 57 and the first sheet 51. FIG. 1 shows, in a non-limiting way, an outline having two second sheets 57 engaged to the first sheet 51 at the bottom edge and top edge, respectively, and arranged in opposition to the first sheet 51. The second sheets 57 may be directly connected to the top edge and bottom edge, respectively, of the first portion 52 of the first sheet 51. The first and second portions 58, 59 of the second sheet 57 are intended to form, respectively, the closure portion 9 and inserting portion 10 of the closure system 7 of container 1 described above.

The blank 50 also comprises at least one third sheet 60 joined in a single piece with the first sheet 51 at an end edge of the second portion 54 of the first sheet. The third sheet 60 is intended to form the second coupling portion 13 of container 1. The third sheet 60 comprises a first portion 61 and a second portion 62 which are respectively configured to define the second and first panels 13*b*, 13*a* of the second coupling portion 13. As shown, the first portion 61 of the third sheet is interposed between the second portion 62 of the third sheet and the second portion 54 of the first sheet 51.

The second portion 62 of the third sheet 60 comprises a notch 62*a* configured to define a through notch capable of defining-following the folding of the third sheet 60—the through notch of the first panel 13*a*; the notch 62*a* also allows the gripping edge 13*d* of the first panel 13*a* of the second coupling portion 13 to be defined. The first portion 61 of the third sheet 60 comprises at least one respective notch 61*a* configured to define on the first portion 61 of the third sheet: at least one lateral through notch, at least one central body joined in a single piece with said shoulder and movable relative to said shoulder due to the presence of said notch 61*a*. The third sheet 60 comprises at least one third portion 60*a* emerging from at least one of the first and second portions 61, 62 of the third sheet: said third portion 60*a* is configured to define the thrust portion 21.

The blank 50 may also comprise an additional notch 73 made at opposing end edges of the same second portion 54, and suitable for defining the lowering 23.

The blank 50 also comprises at least one fourth sheet 63 joined in a single piece with the second sheet 57 at an end edge of the second portion 59 of the second sheet 57. The fourth sheet 63 comprises at least one first and one second coupling portion 64, 65 intended to form the first coupling portion 12. The blank 50 may comprise two quarter sheets 63 (FIG. 1) engaged to respective second sheets 57 and arranged in opposition to the first sheet 51.

The blank 50 may also comprise at least one notch 69 defined on the first portion 58 of the second sheet 57: the notch 69 has a substantially rectangular closed profile outline defining the through notch 26. The notch 69 may be made such that a tab configured to define the removable tab may remain within the notch.

FIG. 1 shows a blank 50 wherein two third sheets 60 emerge laterally from the first sheet 51 from the second portion 54, one in opposition to the other: there are also two fourth sheets emerging respectively from two second sheets 57 opposed to each other. Such blank are configured to make a container 1 as shown in the attached figures, that is, presenting two opposing passage openings 5: consequently, container 1 comprises two closure systems 7 and respective first and second coupling portions 12, 13.

FIG. 1 further shows a blank 50 comprising two third sheets 60 engaged to the first sheet 51 and arranged in opposition to the latter. The third sheets 60 may be respectively directly connected to the end edges of the second portion 54 of the first sheet 51. FIG. 1 shows, in addition, an outline presenting two quarter sheets 63 joined in a single piece with the two second sheets 57.

Process of Making the Container

Also forming an object of the present invention is a process of making container 1 according to the attached claims. The container 1 is made from a single blank 50 in paper sheet material of the type previously described obtained by one or more die-cutting steps of a single flat precursor sheet in paper material.

The process may comprise a step of engaging a plastic film on at least part of the first prevailing development surface of the blank 50 and, additionally or alternatively, on the second prevailing development surface of the blank 50.

The process involves a step of providing the storage 2. This step involves folding portions 52, 53, 54, 55, 56 and joining these portions (e.g., the second lateral connection portion 56 with the first portion 52), e.g., by gluing, to form storage 2 substantially defining a tube laterally delimited by walls 4*a*, 4*b*, 4*c*, 4*d* and opened at opposing longitudinal ends. Walls 4*a*, 4*b*, 4*c*, 4*d* are defined by the first portion 52, the second portion 54, the central connecting portion 53, and the first lateral wall portion 55, respectively. Alternatively, the storage 2 may be reclosed without providing the step of fixing the walls by glue.

It is useful to specify that the stage of preparing the first sheet 51 may include a die-cutting stage, which allows folding lines coinciding with the longitudinal lateral edges of the portions of the first sheet 51 to be defined on the same sheet. In fact, the folding stages of the portions 52, 53, 54, 55 of the first sheet 51 occur precisely along the longitudinal lateral edges of the portions 52, 53, 54, 55, 56 which are flattened in order to facilitate their handling by folding.

The process also involves providing of the closure system 7. Providing the closure system 7 involves folding the second portion 59 of the second sheet 57 with respect to the first portion 58 of the second sheet 57 and folding the first portion 58 of the second sheet 57 with respect to the first portion 52 of the first sheet 51 so as to form the closure portion 9 and the inserting portion 10 of the previously described closure system 7.

The second coupling portion 13 is defined by means of folding the second coupling portion 62 over the first coupling portion 61 and optionally attaching them by glue; specifically, only a portion of the second coupling portion 62 of the third sheet 60 is glued to the central body of the third sheet; subsequently, the first and second coupling portions of the third sheet are folded over the second coupling portion 54 of the first sheet 51. The at least one side shoulder of the first portion 61 of the third sheet 60 may be attached, such as by glue, to said second portion 54. The central body of the first portion 61 of the third sheet 60 is not directly constrained to the first sheet 51 in such a way that the second coupling portion 13 may be movable relative to the storage 2 between the blocking position and the release position, and vice versa. In fact, only as a result of the overlapping of the second coupling portion 62 of the third sheet above the first coupling portion 61 of the same third sheet 60 is the definition of the seat 40 of the second coupling portion achieved. In fact, the through notch 62*a* from the second sheet is defined by the notch 62*a* performed on the second portion 62, which is blinded by the first portion 61 so that the second portion 62 may define the first panel 13*a* on which the gripping edge 13*d* is defined while the first portion cooperates with the second portion to define the seat 40.

As a result of the folding of the first and second portions 61, 62 of the third sheet 60, the definition of the thrust portion 21 defined by the third portion 60*a* of the third sheet is obtained at the same time.

The first coupling portion 12, on the other hand, is defined by folding the second coupling portion 65 of the fourth sheet 63 above the first coupling portion 64 also of the fourth sheet 63; these portions may be overlapped and glued to each other so that the first coupling portion 64 of the third sheet defines the second tab 12*b* while the first coupling portion 65 defines the first tab 12*a* of the first coupling portion 12.

First, second, third, and fourth sheets are joined in a single piece to define a single blank 50, in one piece, obtainable by a single die-cutting step. Making container 1 may be done on a traditional folding-paste machine.

Method of Opening the Container

The method of opening container 1 involves setting up the container 1 in a closure condition. The method of opening the container 1 involves moving the thrust portion 21 by a manual action of the user or by engaging the opening device 19 to move at least part of the second coupling portion 13 from the blocking position to the release position. Such an action may be performed completely outside of container 1 by a manual action of the user or may be performed by the insertion of a finger of the user or the opening device 19 in traversing through access 26 to generate activation of the thrust portion 21 and subsequent movement of the second coupling portion 13.

For example, such a method may involve at least partially inserting a finger of a user through the through access 26 to contact the coupling portion 21 and moving it along the depth of the through access 26, such that the first and second panels 13*a*, 13*b* of the second coupling portion are tilted and/or moved away from the lateral wall 4*a* to disengage the first and second coupling portions 12, 13. This step also allows the user to reach the gripping portion that enable the user to pull the first coupling portion 12 out of the storage and, consequently allow the closure system 7 to move from the closure condition to the open condition.

Following the disengagement of the first coupling portion 12 from the second coupling portion 13, the method involves moving the closure system 7 by rotation around the edge 6 of the storage 2, resulting in the opening of the container 1. Note also that the opening of the container may further occur as a result of grasping, with one hand, the container from the rear portion 4*b* of the storage. With the same hand, it is then possible to reach and move the thrust portion 21 from the blocking position to the release position without inserting a finger inside the through access 26. The opening of the container occurs as a result of reaching, either by the same hand or by the other hand, the gripping portion and/or and moving the closure system 7 by rotation around the edge 6 of the storage 2.

The method of opening container 1 may further involve at least partially inserting an opening device 19 into the compartment 3 of the storage 2 through the through access 26. The opening device 19 enters the compartment 3 of the storage 2 to interpose itself between the first tab 12*a* of the first coupling portion and the first and second panels 13*a*, 13*b* of the second coupling portion 13, thereby allowing the opening device 19 to disengage said first and second coupling portions. The disengagement of the first coupling portion 12 then allows the extraction of the first coupling portion 12 from the second coupling portion 13 and consequently to switch the closure system 7 from the closure condition to the open condition.

Alternatively, the user may insert a finger through the through access 26 to displace the thrust portion 21 and simultaneously grasp with the same hand the gripping portion of the inserting portion 10 for the disengagement of the first coupling portion 12 from the seat 40. Similarly, the user may insert an opening device 19 through the through access 26 so as to insert said device 19 into the seat 40 and cause the disengagement of the coupling portions 12 and 13 and simultaneously grasp, with the same hand, the gripping portion of the inserting portion 10 to enable the movement of the closure system 7 from the closure condition to the open condition.

Container Closing Method

The method of closing the container 1 involves moving the closure system 7 from the open condition (FIG. 4) to the closure condition by inserting the inserting portion 10 into the compartment 3 of the storage. During the inserting portion 10 into the compartment 3, the insertion of the first coupling portion 12 into the compartment 3 of the storage 2 is also achieved such that said first and second coupling portions 12, 13 engage each other to define the locking condition. In detail, following the insertion of the first coupling portion 12 into the compartment 3, tab 12*a* is configured to insert into the seat 40 such that the support edge 12*d* may abut to the gripping edge 113*b* of the second coupling portion 13, thus defining the locking condition.

While at least one exemplary embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a" or "one" do not exclude a plural number, and the term "or" means either or both, unless the disclosure states otherwise. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

The invention claimed is:

1. A child-proof container comprising:

a storage defining a compartment for housing at least one product, the storage having lateral walls defining at least one passage opening delimited by an edge, said passage opening being configured to put the compartment in communication with the external environment, at least one closure system relatively movable with respect to the storage at least between:

a closure condition where the closure system interdicts communication between the compartment of the storage and the external environment, and an open condition where the closure system allows communication between the compartment and the external environment, at least one first coupling portion carried by the closure system, and at least one second coupling portion carried by the storage, wherein the first and second coupling portions, in the closure condition, are configured to engage with each other to define a locking condition of the container where said first and second coupling portions prevent the closure system from switching from the closure condition to the open condition, wherein the second coupling portion comprises:

at least one first panel comprising at least one through opening at least partially delimited by a gripping edge, and at least one second panel facing the first panel, wherein the first panel is interposed between said second panel and a lateral wall of the lateral walls of the storage directly carrying the second coupling portion, wherein the second panel is arranged at the through opening of the first panel to define, in cooperation with said through opening of the first panel, a blind seat configured to house, during the closure condition of the closure system, at least part of the first coupling portion, wherein the first coupling portion comprises a first tab and a second tab in sheet material and the first tab and the second tab at least partially overlapping each other, wherein at least one of the first tab and second tab, in the closure condition, is arranged at least partially in the blind seat and is engaged to the gripping edge of the first panel of the second coupling portion to define the locking condition, and wherein the first tab of the first coupling portion, in the locking condition, is arranged in the blind seat of the first panel of the second coupling portion, in interposition between the second tab of the first coupling portion and the second panel of the second coupling portion.

2. The child-proof container according to claim 1, wherein the first tab is parallel and constrained to the second tab.

3. The child-proof container according to claim 1, wherein the second panel is directly engaged and overlapped to the first panel, wherein the first and second panels of the second coupling portion lie on respective planes, wherein the lying plane of the first panel is substantially parallel to the lying plane of the second panel.

4. The child-proof container according to claim 1, wherein the second tab of the first coupling portion, in the locking condition, is interposed between the lateral wall of the storage directly carrying the second coupling portion and the first tab of the first coupling portion.

5. The child-proof container according to claim 1, wherein the second tab of the first coupling portion, in the locking condition, is at least partially in direct contact, from one side, with the lateral wall of the storage directly carrying the second coupling portion and with the first tab of the first coupling portion itself.

6. The child-proof container according to claim 1, wherein the second coupling portion is at least partially movable relative to the storage at least between:

a blocking position where the second coupling portion is configured to engage the first coupling portion, and a release position where the second coupling portion is configured to disengage the first coupling portion to allow the closure system to switch from the closure condition to the open condition.

7. The child-proof container according to claim 6, wherein the gripping edge, in the blocking position, has a distance from the lateral wall of the storage directly carrying the second coupling portion that is less than a distance between said gripping edge and the lateral wall when the second coupling portion is in the release position.

8. The child-proof container according to claim 6, wherein at least part of the first panel and at least part of the second panel is movable relative to the storage to define:

the blocking position of the second coupling portion where said first and second panels are alongside the lateral wall of the storage directly carrying said second coupling portion and configured to allow the blocking of the first coupling portion in the blind seat, and the release position of the second coupling portion where said first and second panels are at least partially spaced from the lateral wall of the storage directly carrying said second coupling portion to allow disengagement of the first coupling portion from the blind seat.

9. The child-proof container according to claim 8, wherein the first panel and the second panel of the second coupling portion, in the blocking position, are substantially parallel to a lying plane of the lateral wall of the storage directly carrying said second coupling portion.

10. The child-proof container according to claim 9, wherein a tilt angle between a lying plane of the first and second panels and a lying plane of the lateral wall of the storage directly carrying the second coupling portion, in the release position, is in a range of two degrees to twenty degrees.

11. The child-proof container according to claim 1, wherein the first panel and the second panel are at least partially tiltable relative to the lateral wall of the storage directly carrying the second coupling portion.

12. The child-proof container according to claim 1, wherein the second panel is joined in a single piece to the storage and folded with respect to the lateral wall of the storage to which said second panel is joined in a single piece, in the compartment.

13. The child-proof container according to claim 1, wherein the closure system comprises:

a closure portion configured to at least partially occlude, in the open condition, the at least one passage opening of the storage, and an inserting portion engaged to the closure portion at a fold edge, wherein the inserting portion, in the closure condition, is configured to insert at least partially into the compartment of the storage, wherein the second tab extends seamlessly from the inserting portion while the first tab is folded over the second tab.

14. The child-proof container according to claim 1, wherein the first tab defines a support edge which, in the locking condition, is engaged to the gripping edge defined by the first panel of the second coupling portion.

15. A child-proof container comprising:

a storage defining a compartment for housing at least one product, the storage having lateral walls defining at least one passage opening delimited by an edge, said passage opening being configured to put the compartment in communication with the external environment, at least one closure system relatively movable with respect to the storage at least between:

a closure condition where the closure system interdicts communication between the compartment of the storage and the external environment, and an open condition where the closure system allows communication between the compartment and the external environment, at least one first coupling portion carried by the closure system, and at least one second coupling portion carried by the storage, wherein the first and second coupling portions, in the closure condition, are configured to engage with each other to define a locking condition of the container where said first and second coupling portions prevent the closure system from switching from the closure condition to the open condition, wherein the second coupling portion comprises:

at least one first panel comprising at least one through opening at least partially delimited by a gripping edge, and at least one second panel facing the first panel, wherein the first panel is interposed between said second panel and a lateral wall of the lateral walls of the storage directly carrying the second coupling portion, wherein the second panel is arranged at the through opening of the first panel to define, in cooperation with said through opening of the first panel, a blind seat configured to house, during the closure condition of the closure system, at least part of the first coupling portion, wherein the first coupling portion comprises a first tab and a second tab in sheet material and the first tab and the second tab at least partially overlapping each other, wherein at least one of the first tab and second tab, in the closure condition, is arranged at least partially in the blind seat and is engaged to the gripping edge of the first panel of the second coupling portion to define the locking condition, wherein the second coupling portion is at least partially movable relative to the storage at least between a blocking position where the second coupling portion is configured to engage the first coupling portion, a release position where the second coupling portion is configured to disengage the first coupling portion to allow the closure system to switch from the closure condition to the open condition, and wherein the gripping edge, in the blocking position, has a distance from the lateral wall of the storage directly carrying the second coupling portion that is less than a distance between said gripping edge and the lateral wall when the second coupling portion is in the release position.

16. The child-proof container according to claim 15, wherein at least part of the first panel and at least part of the second panel is movable relative to the storage to define:

the blocking position of the second coupling portion where said first and second panels are alongside the lateral wall of the storage directly carrying said second coupling portion and configured to allow, and the release position of the second coupling portion where said first and second panels are at least partially spaced from the lateral wall of the storage directly carrying said second coupling portion to allow disengagement.

17. The child-proof container according to claim 16, wherein the first panel and the second panel of the second coupling portion, in the blocking position, are substantially parallel to a lying plane of the lateral wall of the storage directly carrying said second coupling portion.

18. The child-proof container according to claim 17, wherein a tilt angle between a lying plane of the first and second panels and a lying plane of the lateral wall of the storage directly carrying the second coupling portion, in the release position, is in a range of two degrees to twenty degrees.

* * * * *